US006014531A

United States Patent [19]

Ebata et al.

[11] Patent Number: 6,014,531

[45] Date of Patent: Jan. 11, 2000

[54] ELECTROPHOTOGRAPHIC PRINTER AND FIXING UNIT CONTROLLING APPARATUS THERFOR

[75] Inventors: Norio Ebata; Daisuke Kobayashi; Shuichi Fujikura, all of Tokyo, Japan

[73] Assignee: Oki Data Corporation, Tokyo, Japan

[21] Appl. No.: 09/198,372

[22] Filed: Nov. 24, 1998

[30] Foreign Application Priority Data

Nov. 27, 1997 [JP] Japan ..... 9-326402

[51] Int. Cl.[7] ..... G03G 15/20

[52] U.S. Cl. ..... 399/69; 399/45

[58] Field of Search ..... 399/33, 43–45, 399/67, 69; 219/216

[56] References Cited

U.S. PATENT DOCUMENTS 4,905,051 2/1990 Satoh et al. ..... 399/69
5,321,481 6/1994 Mathers ..... 399/69
5,555,075 9/1996 Fukano et al. ..... 399/69

FOREIGN PATENT DOCUMENTS 1-244488 9/1989 Japan .

*Primary Examiner*—Arthur T. Grimley
*Assistant Examiner*—Quana Grainger
*Attorney, Agent, or Firm*—Rabin & Champagne, P.C.

[57] ABSTRACT

A fixing unit has a heat roller with a heater element built therein, a pressure roller disposed to oppose the heat roller and holds and advances a print medium therebetween in sandwiched relation. A thermistor is in contact with the heat roller and detects the temperature of the heat roller. Another thermistor detects the temperature of the pressure roller. A control circuit controls energization of the heater element so as to maintain the temperature of the heat roller to a target temperature. The heater element is energized to maintain a constant value of Tc given by an equation Tc=Th+k·Tp where Th is a surface temperature of the heat roller, Tp is a surface temperature of the pressure roller, and k is a coefficient having the range of 0<k<1.

9 Claims, 21 Drawing Sheets

FIG.5

GLOSS OF MAGENTA

| Th [℃] | Tp [℃] | | | | | | |
|---|---|---|---|---|---|---|---|
| | 80 | 90 | 100 | 110 | 120 | 130 | 140 |
| 175 | 11.2 | 12.7 | 13.5 | 13.8 | 15.9 | 17.1 | 17.6 |
| 170 | 9.4 | 10.6 | 11.3 | 11 | 12.5 | 13.8 | 14.1 |
| 165 | 7.9 | 8.7 | 10 | 11.5 | 13.5 | 14.5 | |
| 160 | 6 | 6.4 | 8.9 | 9.3 | 10.3 | 10.6 | |
| 155 | 5.3 | 6.3 | 8.4 | 8 | 9.9 | | |
| 150 | | 5.5 | 6.7 | 6.3 | 7.9 | | |

AR1

FIG.6

FIXING EFFICIENCY OF MAGENTA (%)

| Th [℃] | Tp [℃] | | | | | | |
|---|---|---|---|---|---|---|---|
| | 80 | 90 | 100 | 110 | 120 | 130 | 140 |
| 175 | 100 | 100 | 100 | 100 | 100 | 100 | 100 |
| 170 | 98.5 | 100 | 100 | 100 | 100 | 100 | 100 |
| 165 | 94.5 | 100 | 100 | 100 | 100 | 100 | |
| 160 | 90.2 | 93.2 | 96.2 | 99.2 | 100 | 100 | |
| 155 | 74.9 | 90 | 89.6 | 98.2 | 98.3 | | |
| 150 | | 71.3 | 88.6 | 90.2 | 97.6 | | |

AR2

FIG.7 k=0

| Th \ Tp | 80 | 90 | 100 | 110 | 120 | 130 | 140 |
|---|---|---|---|---|---|---|---|
| 175 | 175 | 175 | 175 | 175 | 175 | 175 | 175 |
| 170 | 170 | 170 | 170 | 170 | 170 | 170 | 170 |
| 165 | 165 | 165 | 165 | 165 | 165 | 165 | |
| 160 | 160 | 160 | 160 | 160 | 160 | 160 | |
| 155 | 155 | 155 | 155 | 155 | 155 | | |
| 150 | | 150 | 150 | 150 | 150 | | |

FIG.8 k=0.1

| Th \ Tp | 80 | 90 | 100 | 110 | 120 | 130 | 140 |
|---|---|---|---|---|---|---|---|
| 175 | 183 | 184 | 185 | 186 | 187 | 188 | 189 |
| 170 | 178 | 179 | 180 | 181 | 182 | 183 | 184 |
| 165 | 173 | 174 | 175 | 176 | 177 | 178 | |
| 160 | 168 | 169 | 170 | 171 | 172 | 173 | |
| 155 | 163 | 164 | 165 | 166 | 167 | | |
| 150 | | 159 | 160 | 161 | 162 | | |

FIG.9 k=0.2

| Th \ Tp | 80 | 90 | 100 | 110 | 120 | 130 | 140 |
|---|---|---|---|---|---|---|---|
| 175 | 191 | 193 | 195 | 197 | 199 | 201 | 203 |
| 170 | 186 | 188 | 190 | 192 | 194 | 196 | 198 |
| 165 | 181 | 183 | 185 | 187 | 189 | 191 | |
| 160 | 176 | 178 | 180 | 182 | 184 | 186 | |
| 155 | 171 | 173 | 175 | 177 | 179 | | |
| 150 | | 168 | 170 | 172 | 174 | | |

FIG.10 k=0.3

| Th \ Tp | 80 | 90 | 100 | 110 | 120 | 130 | 140 |
|---|---|---|---|---|---|---|---|
| 175 | 199 | 202 | 205 | 208 | 211 | 214 | 217 |
| 170 | 194 | 197 | 200 | 203 | 206 | 209 | 212 |
| 165 | 189 | 192 | 195 | 198 | 201 | 204 | |
| 160 | 184 | 187 | 190 | 193 | 196 | 199 | |
| 155 | 179 | 182 | 185 | 188 | 191 | | |
| 150 | | 177 | 180 | 183 | 186 | | |

FIG.11 k=0.4

| Th \ Tp | 80 | 90 | 100 | 110 | 120 | 130 | 140 |
|---|---|---|---|---|---|---|---|
| 175 | 207 | 211 | 215 | 219 | 223 | 227 | 231 |
| 170 | 202 | 206 | 210 | 214 | 218 | 222 | 226 |
| 165 | 197 | 201 | 205 | 209 | 213 | 217 | |
| 160 | 192 | 196 | 200 | 204 | 208 | 212 | |
| 155 | 187 | 191 | 195 | 199 | 203 | | |
| 150 | | 186 | 190 | 194 | 198 | | |

FIG.12 k=0.5

| Th \ Tp | 80 | 90 | 100 | 110 | 120 | 130 | 140 |
|---|---|---|---|---|---|---|---|
| 175 | 215 | 220 | 225 | 230 | 235 | 240 | 245 |
| 170 | 210 | 215 | 220 | 225 | 230 | 235 | 240 |
| 165 | 205 | 210 | 215 | 220 | 225 | 230 | |
| 160 | 200 | 205 | 210 | 215 | 220 | 225 | |
| 155 | 195 | 200 | 205 | 210 | 215 | | |
| 150 | | 195 | 200 | 205 | 210 | | |

FIG.13 k=0.6

| Th \ Tp | 80 | 90 | 100 | 110 | 120 | 130 | 140 |
|---|---|---|---|---|---|---|---|
| 175 | 223 | 229 | 235 | 241 | 247 | 253 | 259 |
| 170 | 218 | 224 | 230 | 236 | 242 | 248 | 254 |
| 165 | 213 | 219 | 225 | 231 | 237 | 243 | |
| 160 | 208 | 214 | 220 | 226 | 232 | 238 | |
| 155 | 203 | 209 | 215 | 221 | 227 | | |
| 150 | | 204 | 210 | 216 | 222 | | |

FIG.14 k=0.7

| Th \ Tp | 80 | 90 | 100 | 110 | 120 | 130 | 140 |
|---|---|---|---|---|---|---|---|
| 175 | 231 | 238 | 245 | 252 | 259 | 266 | 273 |
| 170 | 226 | 233 | 240 | 247 | 254 | 261 | 268 |
| 165 | 221 | 228 | 235 | 242 | 249 | 256 | |
| 160 | 216 | 223 | 230 | 237 | 244 | 251 | |
| 155 | 211 | 218 | 225 | 232 | 239 | | |
| 150 | | 213 | 220 | 227 | 234 | | |

FIG.15 k=0.8

| Th \ Tp | 80 | 90 | 100 | 110 | 120 | 130 | 140 |
|---|---|---|---|---|---|---|---|
| 175 | 239 | 247 | 255 | 263 | 271 | 279 | 287 |
| 170 | 234 | 242 | 250 | 258 | 266 | 274 | 282 |
| 165 | 229 | 237 | 245 | 253 | 261 | 269 | |
| 160 | 224 | 232 | 240 | 248 | 256 | 264 | |
| 155 | 219 | 227 | 235 | 243 | 251 | | |
| 150 | | 222 | 230 | 238 | 246 | | |

FIG.16 k=0.9

| Th \ Tp | 80 | 90 | 100 | 110 | 120 | 130 | 140 |
|---|---|---|---|---|---|---|---|
| 175 | 247 | 256 | 265 | 274 | 283 | 292 | 301 |
| 170 | 242 | 251 | 260 | 269 | 278 | 287 | 296 |
| 165 | 237 | 246 | 255 | 264 | 273 | 282 | |
| 160 | 232 | 241 | 250 | 259 | 268 | 277 | |
| 155 | 227 | 236 | 245 | 254 | 263 | | |
| 150 | | 231 | 240 | 249 | 258 | | |

FIG.17 k=1.0

| Th \ Tp | 80 | 90 | 100 | 110 | 120 | 130 | 140 |
|---|---|---|---|---|---|---|---|
| 175 | 255 | 265 | 275 | 285 | 295 | 305 | 315 |
| 170 | 250 | 260 | 270 | 280 | 290 | 300 | 310 |
| 165 | 245 | 255 | 265 | 275 | 285 | 295 | |
| 160 | 240 | 250 | 260 | 270 | 280 | 290 | |
| 155 | 235 | 245 | 255 | 265 | 275 | | |
| 150 | | 240 | 250 | 260 | 270 | | |

| k | VARIATION OF GLOSS |
|---|---|
| 0 | 6 |
| 0.1 | 4.6 |
| 0.2 | 3 |
| 0.3 | 1.4 |
| 0.4 | 0.4 |
| 0.5 | 1.0 |
| 0.6 | 2.0 |
| 0.7 | 2.6 |
| 0.8 | 3 |
| 0.9 | 3.4 |
| 1.0 | 3.8 |

ELECTROPHOTOGRAPHIC PRINTER AND FIXING UNIT CONTROLLING APPARATUS THERFOR

BACKGROUND OF THE INVENTION

1. Field of the Invention

The present invention relates to a fixing unit controlling apparatus.

2. Description of the Related Art

Electrophotographic printers are provided with a fixing unit for fixing a toner image which has been transferred to a print medium. The fixing unit includes a heating roller having a built-in heater, a pressure roller opposing the heat roller, and an oil roller. The oil roller is impregnated with an offset-preventing liquid such as dimethyl silicone and is in contact with the heat roller.

The fixing unit is controlled so that the surface temperature of the heat roller is maintained constant.

FIG. 40 illustrates changes in the surface temperatures of the heat roller and pressure roller when a continuous printing is performed.

FIG. 41 illustrates changes in the surface temperatures of the heat roller and pressure roller when a plurality of pages are printed intermittently with long intervals between pages. FIGS. 40 and 41 plot time as the abscissa and temperature as the ordinate. Curves labeled "Th" indicate the surface temperature of the heat roller and curves labeled "Tp" represent the surface temperature of the pressure roller.

Referring to FIG. 40, the surface temperature Th of the heat roller is maintained substantially the same at all times if a printing is performed continuously on a plurality of pages of print medium after the fixing unit has become ready for a fixing operation. However, some of the pressure roller heat is lost to each print medium page. Therefore, the pressure roller surface temperature slowly decreases. In contrast, if the printing is performed intermittently with a sufficiently long period of time between adjacent pages, an excess heat is transferred from the heat roller to the pressure roller, so that the surface temperature Tp of the pressure roller will become too high.

Referring to FIG. 41, once the fixing unit has become ready for a fixing operation, the surface temperature Th of the heat roller is maintained substantially the same at all times if a printing is performed intermittently where the fixing unit is stopped every time a page is printed. However, the surface temperature of the pressure roller will increase with time at a slow rate. If the printing is performed with much longer intervals between pages, the surface temperature Th of the heat roller is maintained substantially constant, while the surface temperature of the pressure roller will still increase at a slow rate.

Changes in the surface temperature Th of the pressure roller is a critical factor in color printing. A change of about 10 degrees in the surface temperature Th not only causes the gloss of a color image which deteriorates the quality of the color image, but also leads to "offset phenomenon".

One way of addressing this problem may be to provide a heater in the pressure roller just as in the heat roller so as to maintain the surface temperature Tp within a certain range. This approach requires two heaters which add to the manufacturing cost of the electrophotographic printer. The additional heater consumes an additional electric power, thereby increasing the running cost.

SUMMARY OF THE INVENTION

An object of the invention is to solve the aforementioned drawbacks of the conventional fixing unit.

Another object of the invention is to provide a fixing unit where the quality of printed images are improved, no offset occurs, and the manufacturing cost is low.

A fixing unit has a heat roller with a heater element built therein, a pressure roller disposed to oppose the heat roller and holds and advances a print medium therebetween in sandwiched relation. A thermistor is in contact with the heat roller and detects the temperature of the heat roller. Another thermistor detects the temperature of the pressure roller. A control circuit controls energization of the heater element so as to maintain the temperature of the heat roller to a target temperature.

The heater element is energized to maintain a constant value of Tc given by an equation:

$$Tc=Th+k+Tp$$

where Th is a surface temperature of the heat roller, Tp is a surface temperature of the pressure roller, and k is a coefficient having the range of $0<k<1$.

The value of k is empirical and preferably 0.5.

A medium size detector that detects a width of the print medium may be incorporated, so that the controller selectively sets a value of the coefficient in accordance with the width of the print medium.

The value of the coefficient k is smaller for a print medium having a narrow width than for a print medium having a wide width.

The heat roller may be in pressure contact with the pressure roller.

If $Th<Tp$ and a difference between the surface temperature of the heat roller and the surface temperature of the pressure roller is greater than a predetermined value, then the controller stops an operation of the fixing unit.

If a difference between the surface temperature of the heat roller and the surface temperature of the pressure roller is greater than a predetermined value, the controller stops an operation of the fixing unit.

Further scope of applicability of the present invention will become apparent from the detailed description given hereinafter. However, it should be understood that the detailed description and specific examples, when indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5 illustrates experimental values of gloss for different surface temperatures Th of the heat roller and different surface temperatures Tp of the pressure roller when a magenta toner image is fixed;

FIG. 6 illustrates fixing efficiencies for different surface temperatures Th of the heat roller and different surface temperatures Tp of the pressure roller when the magenta toner image is fixed;

FIGS. 7–17 are tables that list values of Tc for different combinations of Th and Tp for k=0 to k=10 in increments of 0.1;

DETAILED DESCRIPTION OF THE INVENTION

Preferred embodiments will be described with reference to the drawings.

First Embodiment

<Construction of Print Engines>

Figure 1:
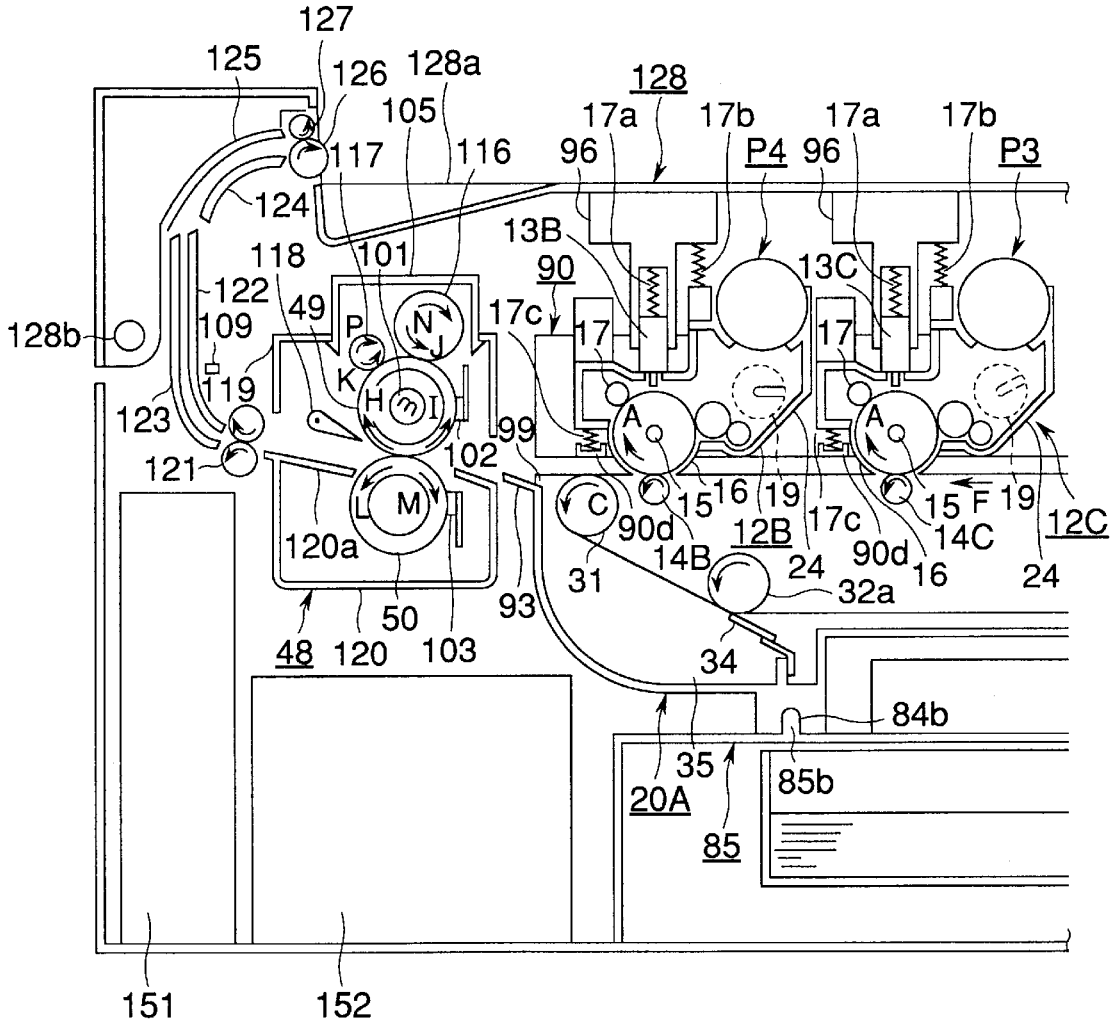
FIG. 1 illustrates a first half of a color image recording apparatus according to a first embodiment.
Figure 2:
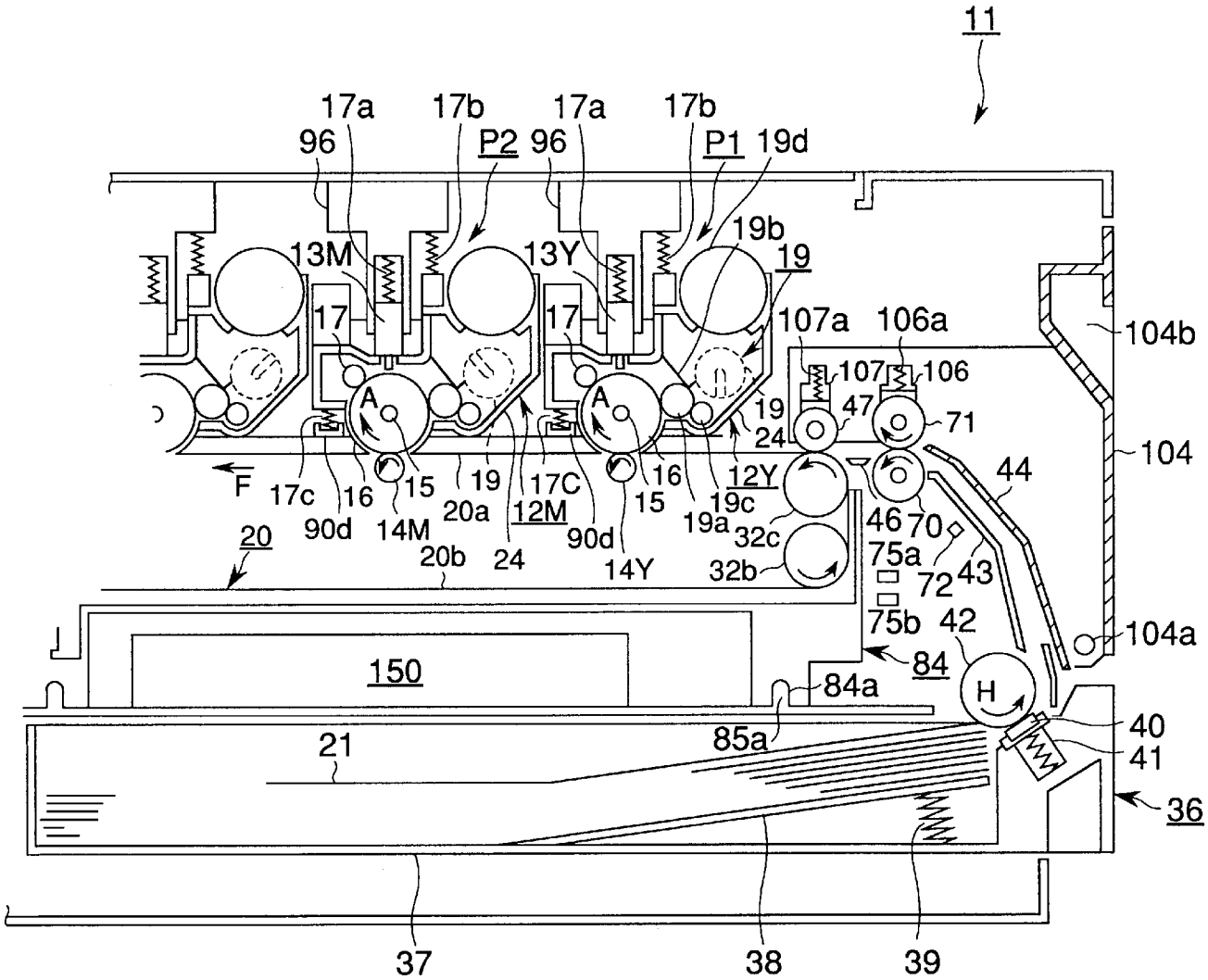
FIG. 2 shows a second half of the apparatus of FIG. 1.

FIG. 1 illustrates a first half of a color image recording apparatus according to a first embodiment and FIG. 2 illustrates a second half. By way of example, the embodiments are described with respect to a color image recording apparatus.

Referring to FIGS. 1 and 2, a color image recording apparatus 11 includes four print engines P1–P4 arranged in line from the paper feeding side to the paper discharging side. The print engines P1–P4 are an electrophotographic print engine with an LED head.

The print engine P1 is for yellow image and includes an image forming cartridge 12Y, a LED head 13Y, and a transfer roller 14Y. The LED head 13Y illuminates the surface of a photoconductive drum 16 in accordance with image data of yellow. The transfer roller 14Y transfers the yellow toner image formed by the image forming cartridge 12Y onto a sheet of recording medium 21. Likewise, the print engine P2 is for magenta and includes an image forming cartridge 12M, a LED head 13M, and a transfer roller 14M. The print engine P3 is for cyan and includes an image forming cartridge 12C, a LED head 13C, and a transfer roller 14C. The print engine P4 is for black and includes an image forming cartridge 12B, a LED head 13B, and a transfer roller 14B. Each of the image forming cartridges 12Y, 12M, 12C, and 12B is supported by a corresponding cartridge frame 24. The image forming cartridges 12Y, 12M, 12C, and 12B are of the same construction and therefore only the image forming cartridge 12Y for yellow will be described by way of example. The image forming cartridge 12Y includes a photoconductive drum 16, a charging roller 17, and a developing unit 19. The photoconductive drum 16 is rotated about a shaft 15 in a direction shown by arrow A. The charging roller 17 uniformly charges the surface of the photoconductive drum 16. The developing unit 19 includes a developing roller 19*a*, a developing blade 19*b*, a sponge roller 19*c*, a toner tank 19*d*, and an agitator 19*e*.

Toner which is of a single, non-magnetic composition supplied from the toner tank 19*d* is agitated by the agitator 19*e* and delivered to the developing roller 19*a* via the sponge roller 19*c* so that the toner applied to the surface of the developing roller 19*a* is made into a thin layer by the developing blade 19*b*. The thin layer of toner is then brought into contact with the photoconductive drum 16 as the developing roller rotates. When the toner is formed into a thin layer, the toner is subjected to friction between the developing roller 19*a* and the developing blade 19*b* so that the toner is triboelectrically charged. In this embodiment, the toner is negatively charged. The developing roller 19*a* is made of a semiconductive rubber material. The toner tank 19*d* is replaced when the toner is exhausted.

The LED heads 13Y, 13M, 13C, and 13B will be described.

Each of the LED heads includes, for example, LED arrays, drive ICs, a circuit board on which the drive ICs are mounted, and a rod lens array that focuses the light emitted from the LED arrays on the surface of the photoconductive drum 16, which are not shown. The LED head receives a color image signal from a host apparatus via an interface, not shown. The LEDs (Light Emitting Diodes) in the LED arrays are selectively energized in accordance with the color image signal, thereby forming an electrostatic latent image on the surface of the photoconductive drum 16. The electrostatic latent image attracts the toner on the developing roller 19*a* with the aid of the Coulomb force and is developed with the toner into a toner image. Each LED head is supported by a supporting member 96 and is pressed downward by a biasing spring 17*a*.

The cartridge frame 24 is urged at a left and right area with respect to the direction of travel of the print medium 21 downward by a biasing spring 17*b*. In this manner, the springs 17*a* and 17*b* urges the image forming cartridge to hold firmly and place them in position. A spring 17*c* is disposed downstream of each image forming cartridge and is mounted to the spring support 90*d* of a guide frame 90. The biasing force of the spring 17*c* is smaller than those of the springs 17*a* and 17*b*.

A transport belt 20 passes transfer areas where the photoconductive drums 16 oppose the transfer rollers 14Y, 14M, 14C, and 14B. The developing units 19 for the respective image forming cartridge 12Y, 12M, 12C, and 12B hold yellow, magenta, cyan, and black toners, respectively, therein.

The LED heads 13Y, 13M, 13C, and 13B receive yellow, magenta, cyan, and black image data, respectively, generated based on a color image signal.

<Construction of Transport Belt Unit>

A transport belt unit 20A is disposed under the image forming cartridges 12Y, 12M, 12C, and 12B. The transport belt unit 20A includes a transport belt 20, a drive roller 31, a driven roller 32*a*–32*c*, a cleaning blade 34, a transfer rollers 14Y, 14M, 14C, and 14B, a neutralizer 99, and a frame, all being supported by a frame 84. The frame 84 has a guide 93 and is formed with guide grooves 84*a* and 84*b*. The frame 84 is assembled to the frame 85 with the guide grooves 84*a* and 84*b* receiving the guides 85*a* and 85*b* of the frame 85 on the body side, thereby being placed in position in the apparatus.

The transport belt unit 20A will be described in detail. The transport belt 20 is a seamless, endless belt made of a high resistance semi-conductive plastic film. The transport belt 20 is disposed about the drive roller 31, driven rollers 32*a*–32*c*, and transfer rollers 14Y, 14M, 14C, and 14B. The electrical resistance of the transport belt 20 is such that a print medium 21 is attracted to the transport belt 20 by the Coulomb force when the print medium 21 is transported on the transport belt 20 and the residual static electricity on the transport belt 20 is automatically neutralized when the print medium 21 has been separated.

The drive roller 31 is coupled to a belt driving motor, not shown, which drives the transport belt 20 to run in a direction shown by arrow C. The driven roller 32*b* is urged by a spring, not shown, in a direction shown by arrow G so that the transport belt 21 is maintained in reasonable tension at all times.

Once the transport belt unit 20A has been assembled into the image recording apparatus, the upper half of the transport belt 20 runs through the transfer areas at the first to fourth print engines P1–P4 in such a way that the transport belt 20 is sandwiched between the photoconductive drums 16 and the transfer rollers 14Y, 14M, 14C, and 14B. The lower half 20*b* of the transport belt 20 is sandwiched between the driven roller 32*a* and the cleaning blade 34.

The cleaning blade 34 is made of a flexible rubber or plastic material and scratches the residual toner left on the transport belt 20. The toner scratched off the transport belt 20 falls into a waste toner tank 35 surrounded by the frame 84. Therefore, when the transport belt 20 is running in the direction shown by arrow F, the transport belt 20 is being cleaned continuously. The attraction roller 47 is urged against the transport belt 20 in such a way that the transport belt 20 is sandwiched between the attraction roller 47 and the transport belt 20, thereby charging the print medium 21 so that the print medium is attracted to the transport belt 20 by the Coulomb force. For this purpose, the attraction roller 47 is made of a high resistance semiconductive rubber material.

A neutralization brush 99 is disposed to oppose the drive roller 31 with the transport belt 20 between the neutralization brush 99 and the drive roller 31. The neutralization brush 99 neutralizes the print medium 21 attracted to and transported on the transport belt so that the print medium 21 leaves the transport belt 20 without difficulty.

Disposed at a lower right area (FIG. 2) of the image recording apparatus 11 is a paper feeding mechanism 36 which includes a paper cassette, paper feeding mechanism, and registry rollers 70 and 71. The paper cassette includes a medium tray 37, lift plate 38, and urging means 39. The feeding mechanism includes a separator 40, spring 41, and appear feeding roller 42.

The print medium 21 accommodated in the medium tray 37 is urged by the lift plate 38, which is upwardly urged by the spring 41, against the paper feeding roller 42. The paper feeding roller 42 and the separator 40 cooperate to feed the print medium page by page. When the paper feeding roller 42 is driven in rotation by a motor, not shown, in a direction shown by arrow H, the print medium 21 sandwiched between the paper feeding roller 42 and the separator 40 is guided by the sheet guides 43 and 44 to the registry rollers 70 and 71. The registry rollers 70 and 71 feed the forward end of the print medium 21 onto the transport belt 20 in timed relation with the print engines. A photosensor 72 is disposed upstream of the registry rollers 70 and 71 with respect to the direction of travel of the print medium 21 and detects the forward end and rearward end of the print medium 21. When the registry rollers 70 and 71 are driven by a motor, not shown, into rotation, the print medium 21 is guided by the medium guide 46 to a contact area between the attraction roller 47 and the transport belt 20.

A front cover 104 is pivotally supported on a shaft 104*a*. When the front cover 104 is opened by holding a hand-hook 104*b*, a locking mechanism, not shown, moves out of engagement with the body of the image recording apparatus so that the registry roller 71, attraction roller 47, a sheet guide 44 are separated from the rest of the recording apparatus. The shafts of the registry roller 71 and the attraction roller 47 are rotatably supported on the guide shafts 106 and 107. The guide shafts 106 and 107 are urged downward by the springs 106*a* and 107*a* mounted in grooves formed in the front cover 104. Thus, once the front cover 104 is closed, the registry roller 71 is urged against the registry roller 71 by the print 106*a* and the attraction roller 47 is urged against the driven roller 32*c* by the spring 107*a*. The driven roller 32*c* is grounded. When a high voltage is applied to the attraction roller 47 with the front cover 104 close, the print medium 21 is attracted to the transport belt 20 with the aid of the potential difference.

<Construction of Fixing Unit>

A fixing unit 48 is disposed downstream of the fourth print engine P4 with respect to the direction of travel of the print medium 21. The fixing unit 48 fixes the toner image on the print medium 21 transported by the transport belt 20. The fixing unit has the heat roller 49 and the pressure roller 50. The heat roller heats the toner deposited on the print medium 21 to fuse the toner image. The pressure roller 50 is urged against the heat roller by the spring, not shown. The heat roller 49 and pressure roller 50 are driven in rotation by the fixing unit motor, not shown, so that the heat roller 49 rotates in directions shown by arrows H and I and the pressure roller 50 rotates in directions shown by arrows L and M.

The heat roller 49 has a hollow cylindrical core metal made of, for example, aluminum, The metal core is covered with a heat-resistive resilient layer such as a silicone rubber and further covered with a layer of a parting agent such as PFA, ETTE, and others of TEFLON™ family. Alternatively, the parting agent may be applied directly to the core metal. There is provided a heater 101 such as a halogen lamp in the core metal.

The pressure roller 50 has a metal core made of, for example, aluminum, stainless or others covered with a heat-resistive, non-resilient layer of a heat-resistant plastic material, and further covered with a parting agent such as PFA, ETTE, and others of the TEFLON™ family. The heat roller 49 having a heat resistive layer applied thereon and the pressure roller 50 having a non-heat-resistant layer applied thereon are in pressure contact with each other to form a nip therebetween.

A thermistor 102 as a first temperature detector is disposed in contact with the outer surface of the heat roller 49 and detects the surface temperature of the heat roller 49. The output of the thermistor 102 is sent to a control circuit 51 (FIG. 3) which energizes the heater 101 intermittently in accordance with the output of the thermistor 102 so as to maintain the surface temperature of the heat roller 49 within a predetermined range. A thermistor 103 as a second temperature detector is disposed in contact with the outer surface of the pressure roller 50 and detects the surface temperature of the pressure roller 50. The output of the thermistor 103 is sent to the control circuit 51 which energizes the heat roller 101 so as to maintain the surface temperature of the pressure roller 50 within a predetermined range.

An oil roller 116 is disposed on the circumferential surface of the heat roller 49 and is rotatable in direction shown by arrows J and N. The oil roller is impregnated with an offset-preventing liquid such as dimethyl silicone and is in contact with the heat roller 49 so that the offset preventing liquid is applied to the heat roller 49 as the heat roller 49 rotates. In this manner, the offset phenomenon is prevented. A cleaning roller 117 is disposed at a location such that when the heat roller 49 rotates in the direction shown by arrow H, the cleaning roller 117 is upstream of the oil roller 116 and downstream of the pressure roller 50 with respect to the rotation of the heat roller 49. The cleaning roller 117 is rotatable either in a direction shown by arrow K or in a direction shown by arrow P. The cleaning roller 117 is made of a material which shows good oil absorption and to which toner adheres easily.

<Discharge Section, Power Supplies, and Others>

A pair of transport rollers 121 is disposed downstream of a separation flap 118 and sends the print medium discharged from the fixing unit 48 via guides 122–125 to the discharge rollers 126 and 127. The discharge rollers 126 and 127 then send the print medium 21 to an upper stacker 128*a* of an upper cover. The photosensor 109 detects the rearward end of the print medium 21.

The upper cover 128 is rotatable about a shaft 128*b* to close or to open. Switches, not shown, are provided on the body of the apparatus and operated drivingly with the open and close operation of the upper cover 128. The switches are opened when the upper cover 128 is opened and closed when the upper cover 128 is closed. The upper cover 128 supports support covers of the LED heads 13Y, 13M, 13C, and 13B, guides 124 and 125 and the discharge rollers 126 and 127. When the upper cover 128 is opened, the image forming cartridges 12Y, 12M, 12C, and 12B are moved upward by the urging forces of the springs 17*c* so that the photoconductive drums 16 move out of contact engagement with the transport belt 20.

Disposed immediately over the transport belt 20 are the charging roller 17, developing roller 19*a*, sponge roller 19*c*, transfer rollers 14Y, 14M, 14C, and 14B and a high voltage power supply 50 for applying a high voltage to the attraction roller 47. Disposed immediately under the fixing unit 48 are a circuit controller 151 and a low voltage power supply 152 for supplying a low voltage electric power to the circuit controller 151.

<Overall Control Circuit>

The overall control circuit of the image recording apparatus will be described.

Figure 3:
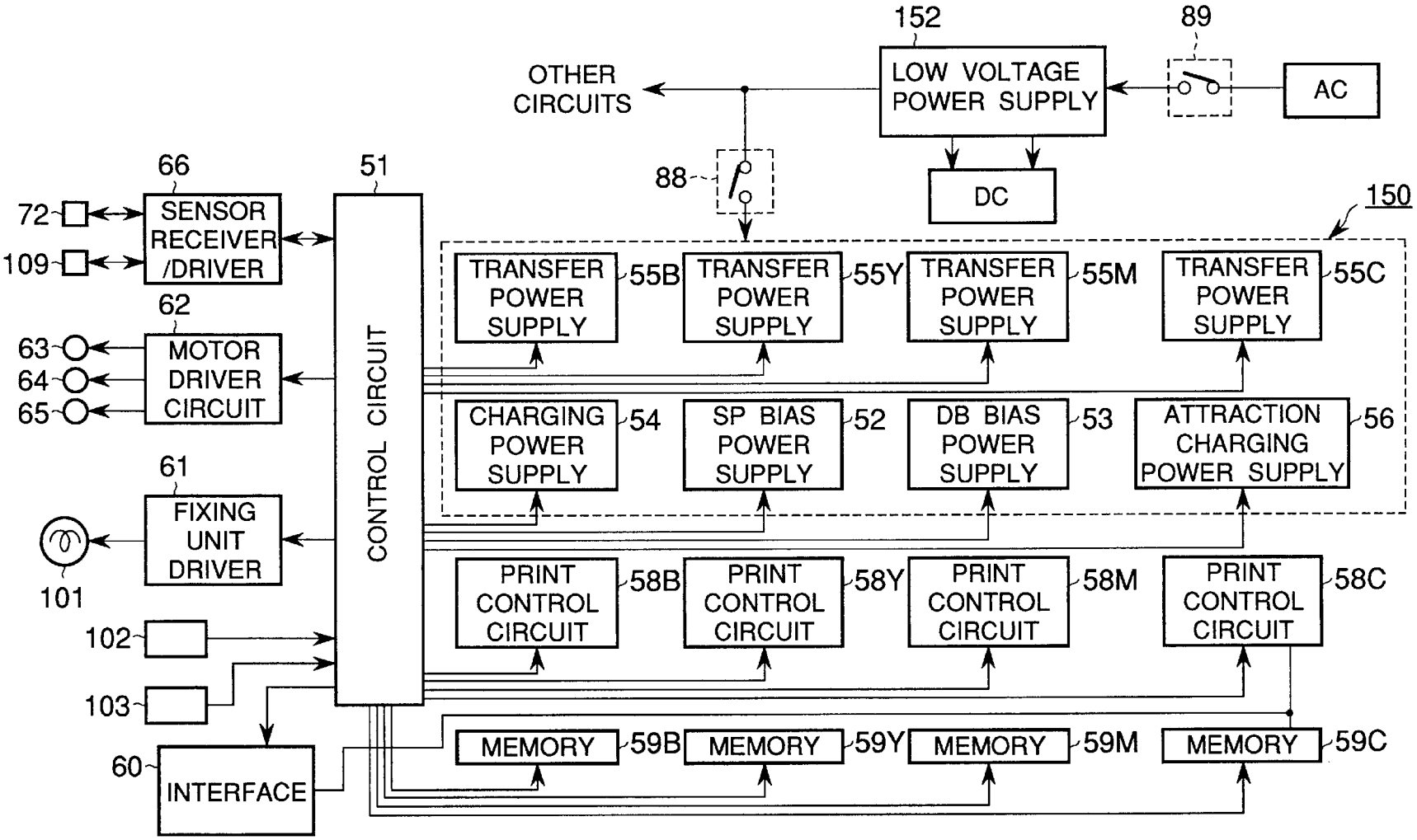
FIG. 3 is a block diagram illustrating the color image recording apparatus according to the first embodiment.

FIG. 3 is a block diagram illustrating the color image recording apparatus according to the first embodiment. Transfer power supplies 55Y, 55M, 55C, and 55B and print control circuit 58Y, 58M, 58C, and 58B are for image forming cartridges for yellow, magenta, cyan, and black, respectively.

Referring to FIG. 3, a control circuit 51 is in the form of a microprocessor having a working register, timer, ROM and others, and performs the overall control of the image recording apparatus 11. The control circuit 51 is connected to an SP bias power supply 52, a DB bias power supply 53, a charging power supply 54, and a transfer power supply 55. The SP power supply 52 supplies electric power to sponge rollers 19*c* of the print engines P1–P4. The DB bias power supply 53 applies voltages to the developing rollers 18*a* of the developing unit 19. The charging power supply 54 applies voltages to charging rollers 17 of the print engines P1–P4, respectively. The transfer power supply 55 supplies voltages to the transfer rollers 14Y, 14M, 14C, and 14B, respectively.

The control circuit 51 is connected to the attraction charging power supply 56. The control circuit 51 controls the attraction charging power supply 56 to supply a charging voltage to the attraction roller 47 and connects the driven roller 32*c* to the ground. Thus, a potential difference between the driven roller 32*c* and the attraction roller 47 generates a Coulomb force by which the print medium 21 is attracted to the transport belt 20. The shafts of the photoconductive drums 16 are grounded to the ground via wiring elements, not shown.

The SP bias power supply 52, DB bias power supply 53, charging power supply 54, attraction charging power supply 56, and transfer power supplies 55Y, 55M, 55C, and 55B form a high voltage power supply 150 and are turned on and off in accordance with instructions from the control circuit 51. The control circuit 51 is connected to print control circuit 58Y, 58M, 58C, and 58B which control the first to fourth print engines P1–P4. The print control circuits receive yellow, magenta, cyan, and black image data from memories 59Y, 59M, 59C, and 59B, respectively. Upon instructions from the control circuit 51, the print control circuits 58Y, 58M, 58C, and 58B transfer the image data for the corresponding colors to the LED head 13Y, 13M, 13C, and 13B, respectively. The control circuit 51 controls the length of time during which the LEDs of the LED arrays illuminate the photoconductive drum, thereby forming an electrostatic latent image on the photoconductive drum 16.

For this purpose, when an interface 60 receives a color image signal from, for example, a host computer, not shown, the interface 60 decomposes the color image signal into yellow image data, magenta image data, cyan image data, and black image data, and stores the image data into memories 59Y, 59M, 59C, and 59B, respectively.

The control circuit 51 is connected to a fixing unit driver 61 as a temperature controlling means, motor driver circuit 62 as a driver/controller means, and a sensor receiver/driver 66. The fixing unit driver 61 causes the heater 101 in the heat roller 49 to be energized or deenergized so that the surface temperature of the heat is maintained within a predetermined range.

The motor drive circuit 62 drives the motor 63 in rotation, thereby causing the rotations of the transfer rollers 14Y, 14M, 14C, and 14B of the four print engines P1–P4, photoconductive drums 16, charging rollers 17, developing rollers 19*a*, sponge rollers 19*c*, drive roller 31, registry rollers 70 and 71, and attraction roller 47. The motor driver circuit 62 drives the fixing motor 65 in rotation, thereby rotating the heat roller 49, pressure roller 50, discharge rollers 126 and 127, and pair of transport rollers 121. The motor driver circuit 62 also drives a rotational direction switching means, not shown, thereby switching the rotation of the fixing motor 65 between the forward direction and reverse direction to change the directions of rotation of the heater roller 49 and pressure roller 50.

The structural elements which are driven by the motors 63 and 64 and fixing motor 65 are coupled via gears or belts, not shown. The sensor receiver/driver 66 drives the photosensors 72 and 109 to operate and sends the output signals of the photosensors 72 and 109 as detection signals to the control circuit 51.

A low voltage power supply 152 applies d-c low voltages to the control circuit 51, print control circuits 58Y, 58M, 58C, and 58B, memories 59Y, 59M, 59C, and 59B, and high voltage power supply 150. The high voltage power supply 150 receives the low voltage from the power supply 152 and converts it into high voltages by means of, for example a transformer, not shown. Disposed between the low voltage power supply 152 and the high voltage power supply 150 is a switch 88. The switch 88 opens when the upper cover 128 is opened, and closes when the upper cover 128 is closed. Thus, when the upper cover 128 is opened, the output of the low voltage power supply 152 is not supplied to the high voltage power supply 150, thereby shutting down electric power to the charging roller 17, developing roller 19*a*, sponge roller 19*c*, and transfer rollers 14Y, 14M, 14C, and 14B. A switch 89 is an a-c current switch which is operated to switch on and off the commercial electric power of a-c 100 V.

<Operation of Image Recording Apparatus>

The operation of the image recording apparatus of the aforementioned construction will now be described. When the a-c switch 89 is closed, the low voltage power supply 152 operates to supply low voltages to the control circuit 51, print control circuits 58Y, 58M, 58C, and 58B, memories 59Y. 59M, 59C, and 59B, and high voltage power supply 150. The control circuit 51 performs a predetermined initialization of the image recording apparatus and then drives the fixing unit driver 61 so that the heat roller 49 is warmed up to a temperature within a predetermined range.

Upon completion of the initialization of the image recording apparatus 11, the control circuit 51 waits for a color image signal which is sent from the host computer via the interface 60. When the control circuit 51 has received the color image signal, the control circuit 51 generates the yellow, magenta, cyan, and black image data based on the color image signal, and stores the image data of the respective colors into the corresponding memories 59Y, 59M, 59C, and 59B, respectively.

Then, when the printing operation has started after reception of the color image signal, the control circuit 51 drives the fixing unit driver 61 to again energize the heater 101 so as to increase the surface temperature of the heat roller 49.

The control circuit 51 drives the motor driver circuit 62 to drive the motor 63 in rotation, thereby rotating the feed roller 42. The feed roller 42 rotates to feed a page of print medium 21 from the medium tray 37 to the sheet guides 43 and 44. When the photosensor 72 detects the forward end of the print medium 21 and outputs a detection signal via the sensor receiver/driver 66 to the control circuit 51, the control circuit 51 drives the motor 63 to cause the print medium to travel by a predetermined distance. When the forward end of the print medium 21 has reached the registry rollers 70 and 71, the control circuit 51 causes the motor 63 to rotate, thereby further advancing the print medium 21 a short distance so that the forward end of the print medium 21 is pressed against the contact area of the registry rollers 70 and 71 to have little slack in the print medium 21. The slack eliminates any skew of the print medium 21.

Then, the control circuit 51 causes the motor driver circuit 62 to drive the motor 64, thereby rotating the motor transfer rollers 14Y, 14M, 14C, and 14B, photoconductive drums 16, charging rollers 17, developing rollers 19*a*, sponge rollers 19*c*, drive roller 31, registry rollers 70 and 71, and attraction roller 47, and turns on the attraction charging power supply 56 to apply a voltage to the attraction roller 47. The control circuit 51 also causes the motor driver circuit 62 to drive the fixing motor 65, thereby rotating the heat roller 49, pressure roller 50, oil roller 116, and cleaning roller 117 in the directions shown by arrows H, I, J, and K, respectively.

The registry rollers 70 and 71 are rotated in the directions shown by arrows to guide the print medium 46 along the transport path. When the forward end of the print medium 21 reaches the contact area of the attraction roller 47 and the transport belt 20, the print medium 21 is attracted to the transport belt 20 due to the Coulomb force. When the rearward end of the print medium 21 leaves the separator 40, the control circuit 51 causes the motor driver circuit 62 to stop the motor 63.

Immediately after the forward end of the print medium 21 has passed the attraction roller 47, the control circuit 51 turns on the charging power supply 54, DB bias power supply 53, and SP bias power supply 52 so as to apply voltages to the charging roller 17, developing roller 19*a*, and sponge roller 19*c*. As a result, the surfaces of the photoconductive drums 16 are uniformly charged by the corresponding charging rollers 17, and the sponge roller 19*c* and the developing roller 19*a* receive predetermined high voltages.

The control circuit 51 reads yellow image data for one line to be printed from the memory 59Y, and sends it to the print control circuit 58Y. In response to an instruction from the control circuit 51, the print control circuit 58Y converts the yellow image data received from the memory 59Y into a form with which the LED head 13Y can operate, and then sends it to the LED head 13Y. Then, the LED head 13Y turns on its LEDs corresponding to the yellow image data to form a latent image for one line on the surface of the photoconductive drum 16. In this manner, an electrostatic latent image is formed in accordance with the yellow image data sent from the memory 59Y on a line-by-line basis. When an electrostatic latent image for one page has been formed on the photoconductive drum, the exposure operation completes for the page.

The electrostatic latent image receives yellow toner from the developing roller 19*a*, being developed with the yellow toner into a yellow toner image.

When the forward end of the print medium 21 has reached the contact area between the photoconductive drum 16 and the transfer roller 14Y, the control circuit 51 turns on the transfer power supply 55Y so that the yellow toner image on the photoconductive drum 16 is transferred to the print medium 21 by electrostatic attraction between the photoconductive drum 16 and the transfer roller 14Y. The toner image for a large number of lines are transferred one by one to the print medium as the photoconductive drum 16 rotates, thereby one page of toner image is transferred to the print medium.

When the print medium 21 has reached the transfer area, the control circuit 51 turns off the transfer power supply 55Y. The transport belt 20 is still running so that the print medium 21 travels from the image forming cartridge 12Y to the image forming cartridge 12M where a magenta toner image is transferred to the print medium 21.

Then, the control circuit 51 reads the magenta image data for one line to be printed from the memory 59M and sends it to the print control circuit 58M. In response to an instruction from the control circuit 51, the print control circuit 58M converts the magenta image data received from the memory 59M into a form with which the LED head 13M can operate, and then sends it to the LED head 13M. Then, the LED head 13M turns on its LEDs corresponding to the magenta image data to form a latent image for one line on the surface of the photoconductive drum 16. In this manner, an electrostatic latent image is formed in accordance with the magenta image data sent from the memory 59Y on a line-by-line basis. When an electrostatic latent image for one page has been formed on the photoconductive drum 16, the exposure operation completes for the page.

The electrostatic latent image receives magenta toner from the developing roller 19*a*, being developed with the magenta toner into a magenta toner image.

When the forward end of the print medium 21 has reached the contact area between the photoconductive drum 16 and the transfer roller 14M, the control circuit 51 turns on the transfer power supply 55M so that the magenta toner image on the photoconductive drum 16 is transferred to the print medium 21 by electrostatic attraction between the photoconductive drum 16 and the transfer roller 14M. The toner image for a large number of lines are transferred one by one to the print medium 21 as the photoconductive drum 16 rotates, thereby one page of toner image is transferred to the print medium 21 in superposition. When the print medium 21 has reached the transfer area, the control circuit 51 turns off the transfer power supply 55M.

The transport belt 20 is still running so that the print medium 21 travels from the image forming cartridge 12M to the image forming cartridge 12C where a cyan toner image is transferred to the print medium 21.

Then, the control circuit 51 reads cyan image data for one line from the memory 59C and sends it to the print control circuit 58C. In response to an instruction from the control circuit 51, the print control circuit 58C converts the cyan image data received from the memory 59C into a form with which the LED head 13C can operate, and sends it to the LED head 13C. Then, the LED head 13C turns on its LEDs corresponding to the cyan image data to form a latent image for one line on the surface of the photoconductive drum 16. In this manner, an electrostatic latent image is formed in accordance with the cyan image data sent from the memory 59C on a line-by-line basis. When an electrostatic latent image for one page has been formed on the photoconductive drum 16, the exposure operation completes for the page.

The electrostatic latent image receives cyan toner from the developing roller 19*a*, being developed with the cyan toner into a cyan toner image.

When the forward end of the print medium 21 has reached the contact area between the photoconductive drum 16 and the transfer roller 14C, the control circuit 51 turns on the transfer power supply 55C so that the cyan toner image on the photoconductive drum 16 is transferred to the print medium 21 by electrostatic attraction between the photoconductive drum 16 and the transfer roller 14C. The toner image for a large number of lines are transferred one by one to the print medium 21 as the photoconductive drum 16 rotates, thereby one page of toner image is transferred to the print medium 21 in superposition. When the print medium 21 has reached the transfer area, the control circuit 51 turns off the transfer power supply 55C.

The transport belt 20 is still running so that the print medium 21 travels from the image forming cartridge 12C to the image forming cartridge 12B where a black toner image is transferred to the print medium 21.

Then, the control circuit 51 reads black image data for one line to be printed from the memory 59B and sends it to the print control circuit 58B. In response to an instruction from the control circuit 51, the print control circuit 58B converts the black image data received from the memory 59B into a form with which the LED head 13B can operate and then sends it to the LED head 13B.

Then, the LED head 13B turns on its LEDs corresponding to the black image data to form a latent image for one line on the surface of the photoconductive drum 16. In this manner, an electrostatic latent image is formed in accordance with the black image data sent from the memory 59B on a line-by-line basis. When an electrostatic latent image for one page has been formed on the photoconductive drum 16, the exposure operation completes for the page.

The electrostatic latent image receives black toner from the developing roller 19*a*, being developed with the black toner into a black toner image.

When the forward end of the print medium 21 has reached the contact area between the photoconductive drum 16 and the transfer roller 14B, the control circuit 51 turns on the transfer power supply 55B so that the black toner image on the photoconductive drum 16 is transferred to the print medium 21 by electrostatic attraction between the photoconductive drum 16 and the transfer roller 14B. The toner image for a large number of lines are transferred one by one to the print medium 21 as the photoconductive drum 16 rotates, thereby one page of toner image is transferred to the print medium 21 in superposition.

When the rearward end of the print medium 21 has reached the transfer area, the control circuit 51 turns on the transfer power supply 55B.

In the aforementioned manner, the images of the respective colors are transferred in register into a full color image. The print medium 21 is then transported by the transport belt 20 to the neutralization brush 99 which neutralizes the charges on the print medium 21. As a result, when the print medium 21 passes above the drive roller 31, the print medium 21 leaves the transport belt 20 and is guided by the guide 93 to the fixing unit 48.

<Operation of Fixing Unit>

The heat roller 49 and the pressure roller 50 are rotated in the directions shown by arrows H and L, respectively. The print medium 21 passes between the heat roller 49 and the pressure roller 50 so that the toner image on the print medium 21 is fixed into a full color image.

Upon completion of the fixing operation, the print medium 21 is transported by the transport rollers 121 and guided by the guides 122–125 to the discharge rollers 126 and 127. Then, the print medium 21 is discharged by the discharge rollers 126 and 127 to the upper stacker 128*a*. When the photosensor 109 detects the rearward end of the print medium 21, the control circuit 51 knows that the print medium 21 has been discharged.

When the print medium 21 has been discharged, the control circuit 51 turns of the SP bias power 52, DB bias power supply 53, and charging power supply 54, and causes the motor drive circuit 62 to stop the motor 64.

<Temperature Controlling Operation of Fixing Unit>

The temperature controlling operation of the fixing unit 48 will be described.

Figure 4:
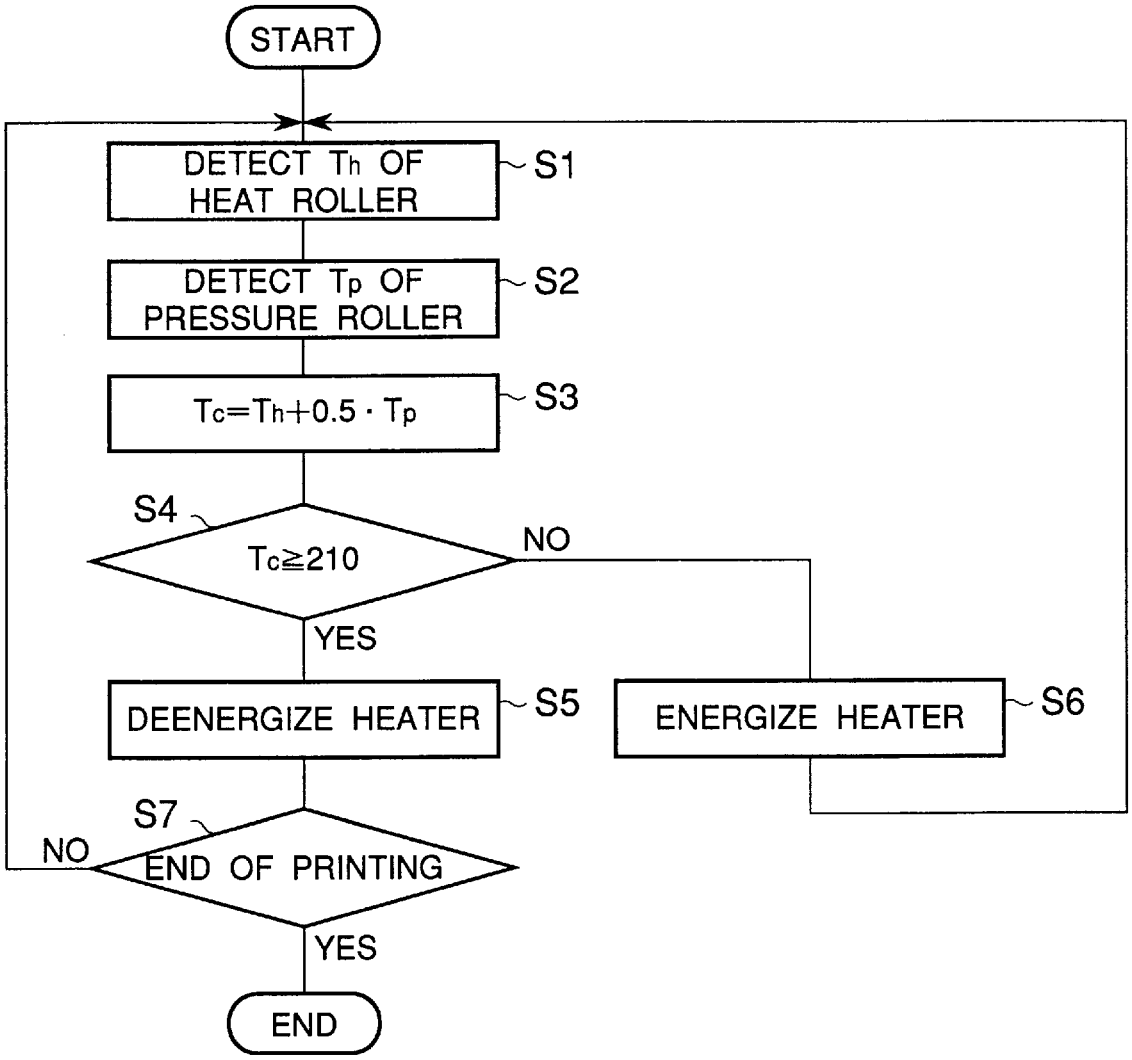
FIG. 4 is a flowchart illustrating the operation of the fixing unit according to the first embodiment.
Figure 18:
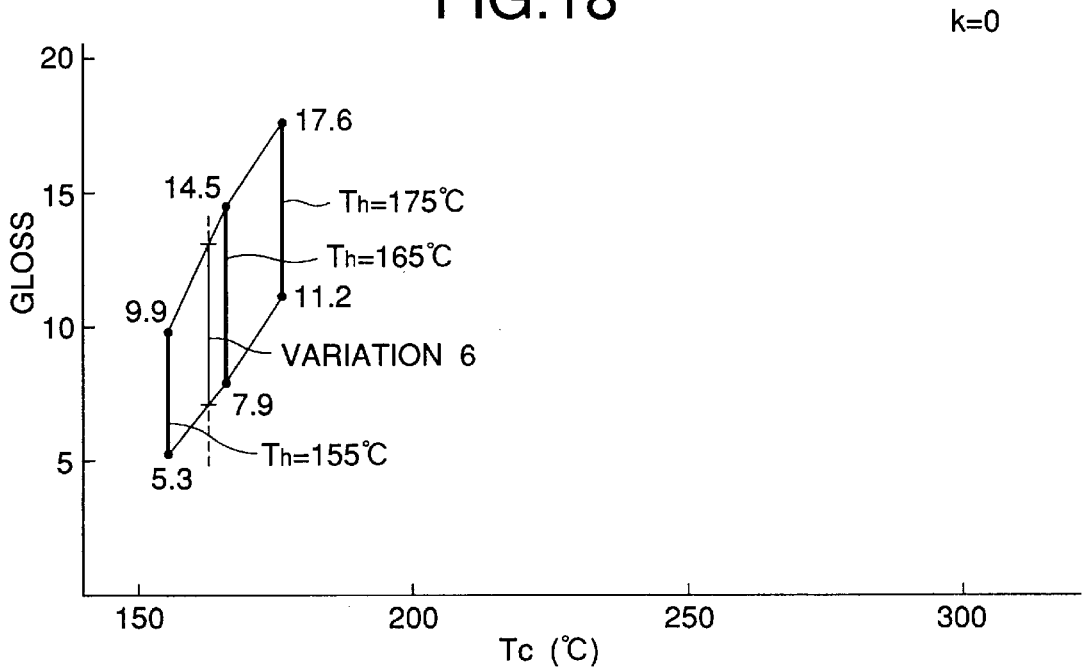
FIGS. 18–28 show graphs for Th=155° C., Th=165° C., and Th=175° C.
Figure 19:
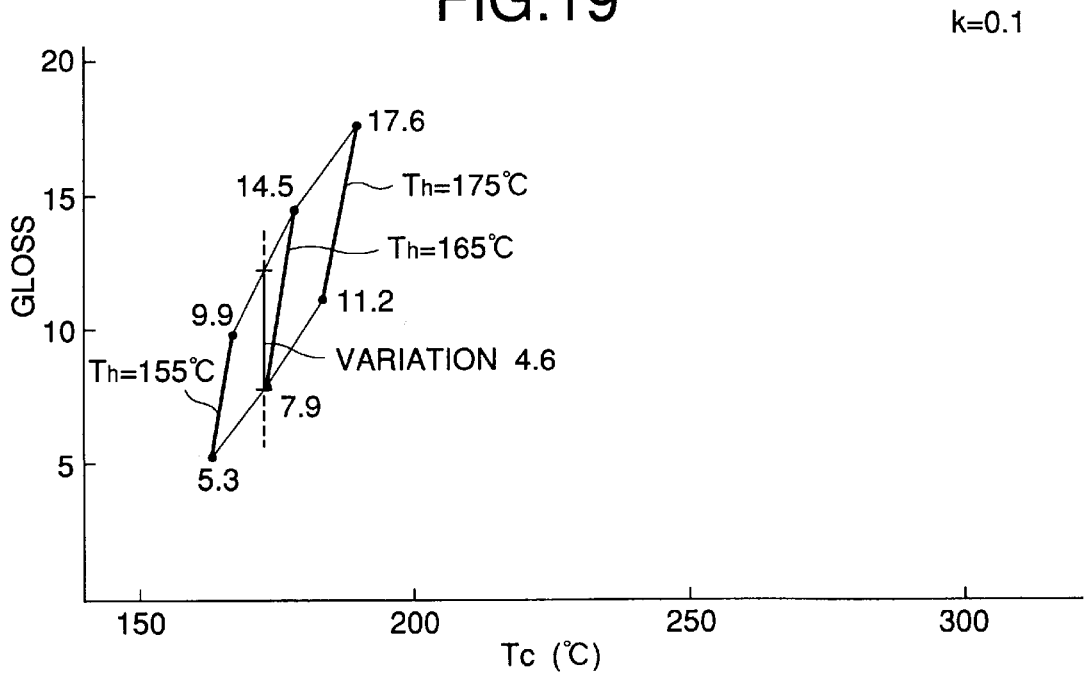
Figure 20:
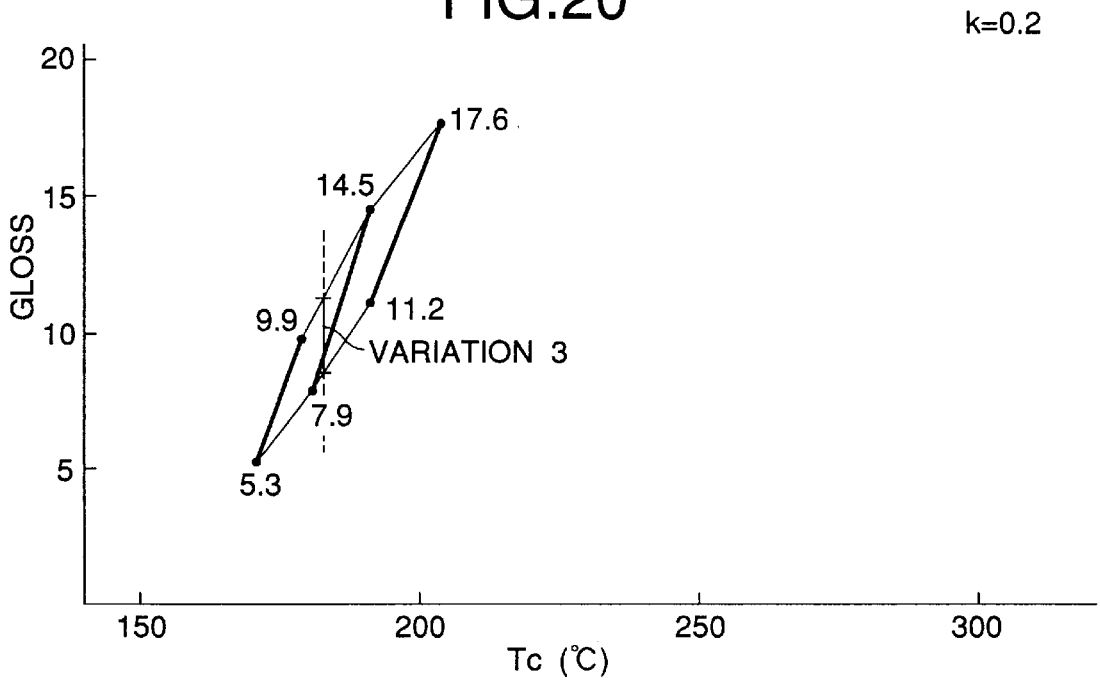
Figure 21:
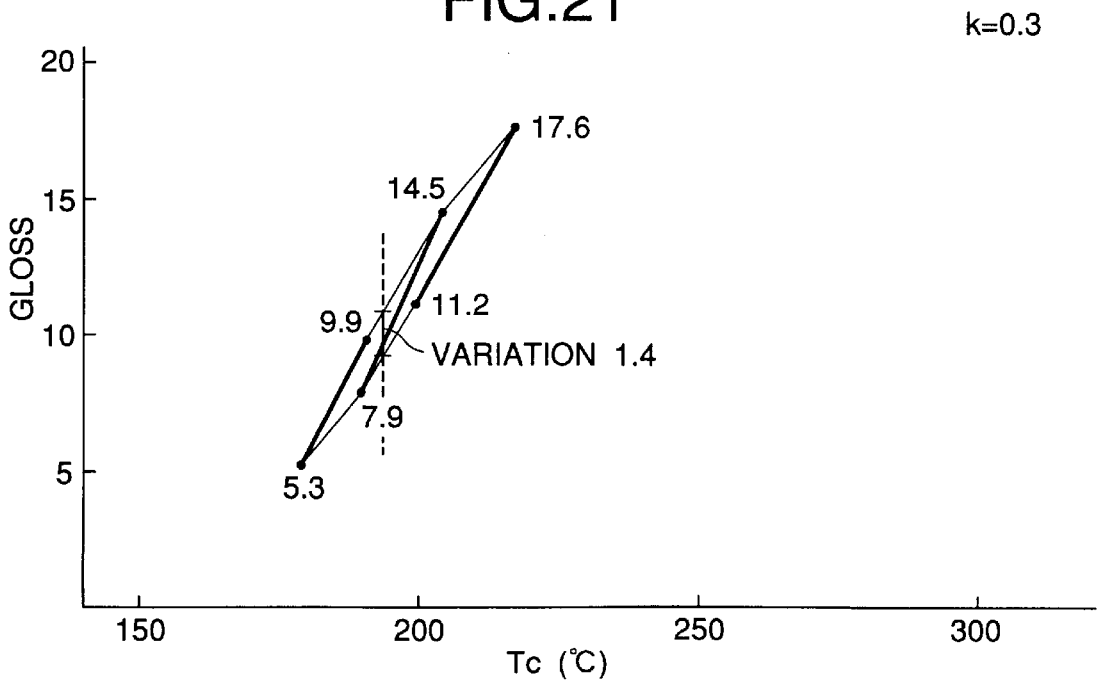
Figure 22:
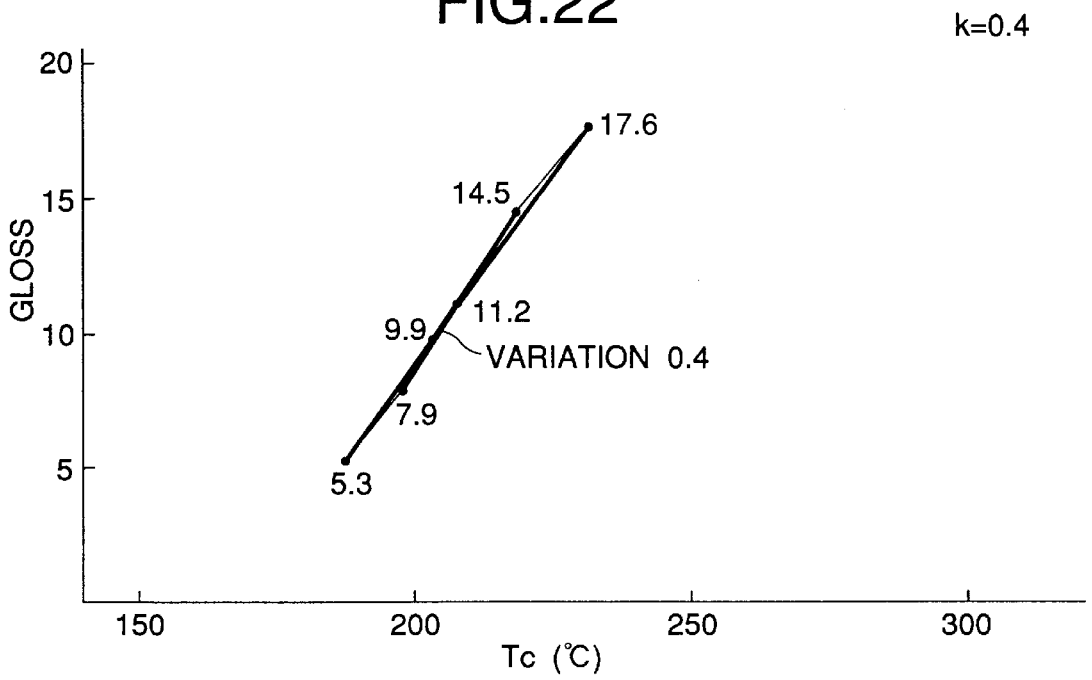
Figure 23:
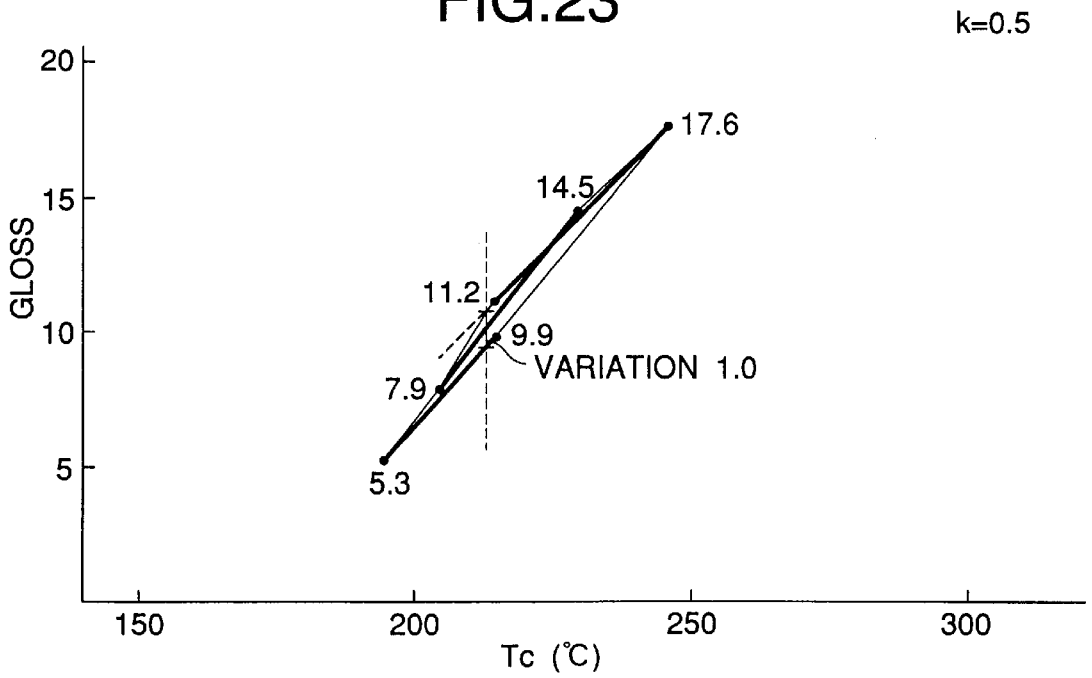
Figure 24:
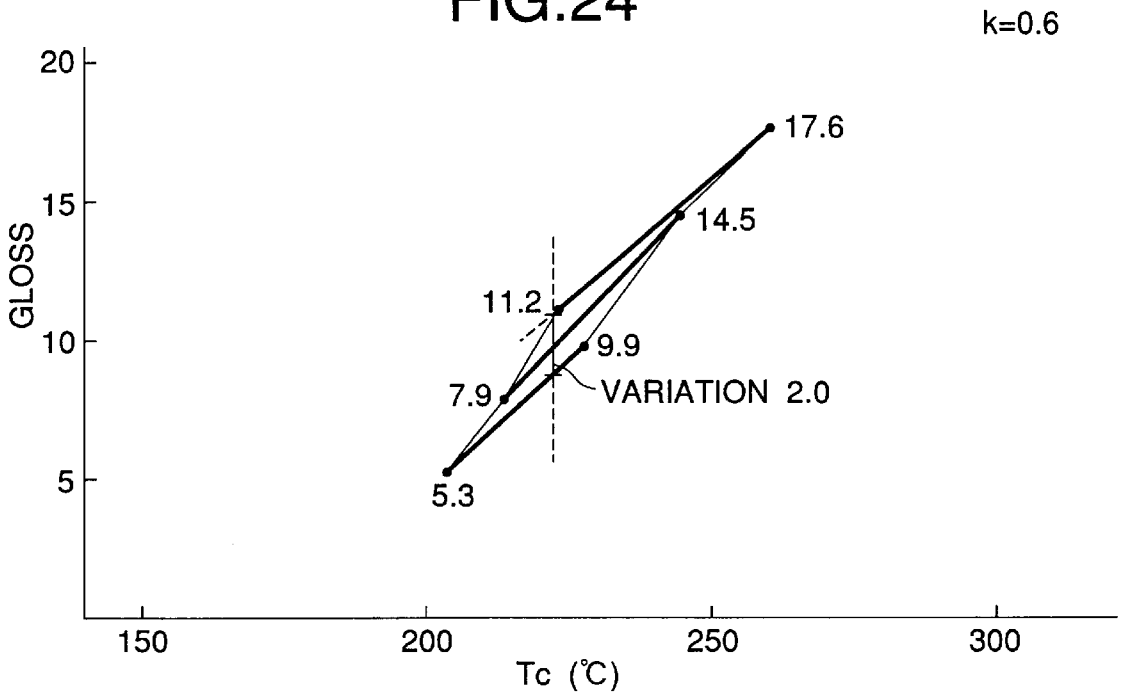
Figure 25:
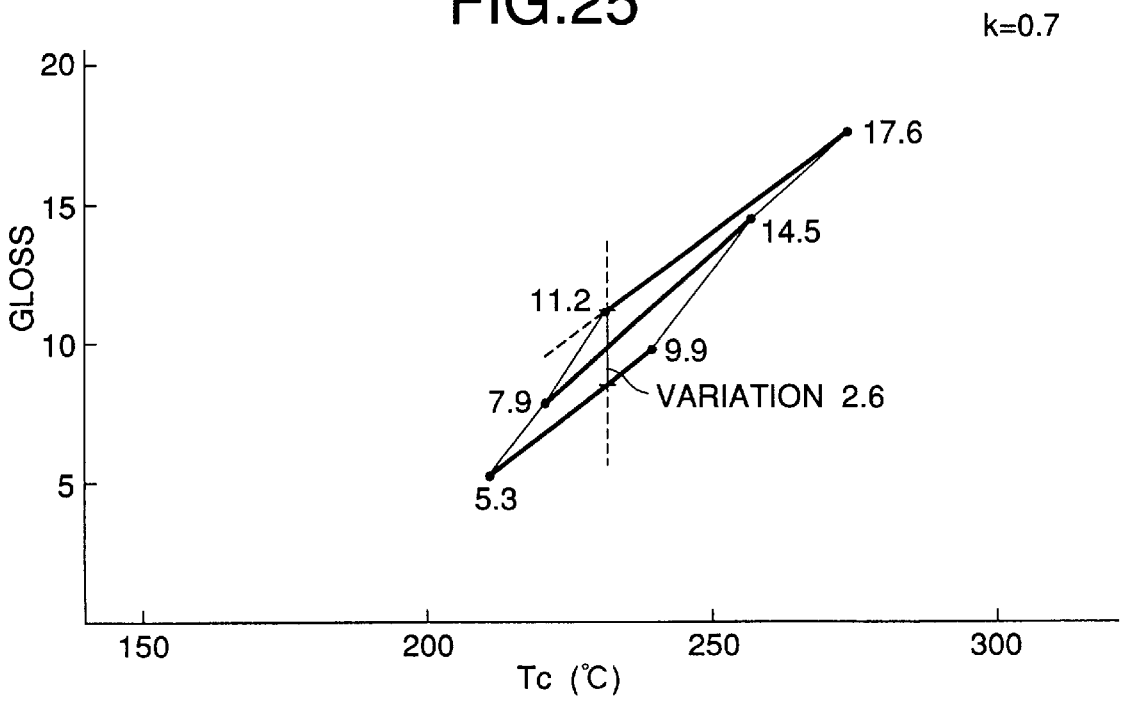
Figure 26:
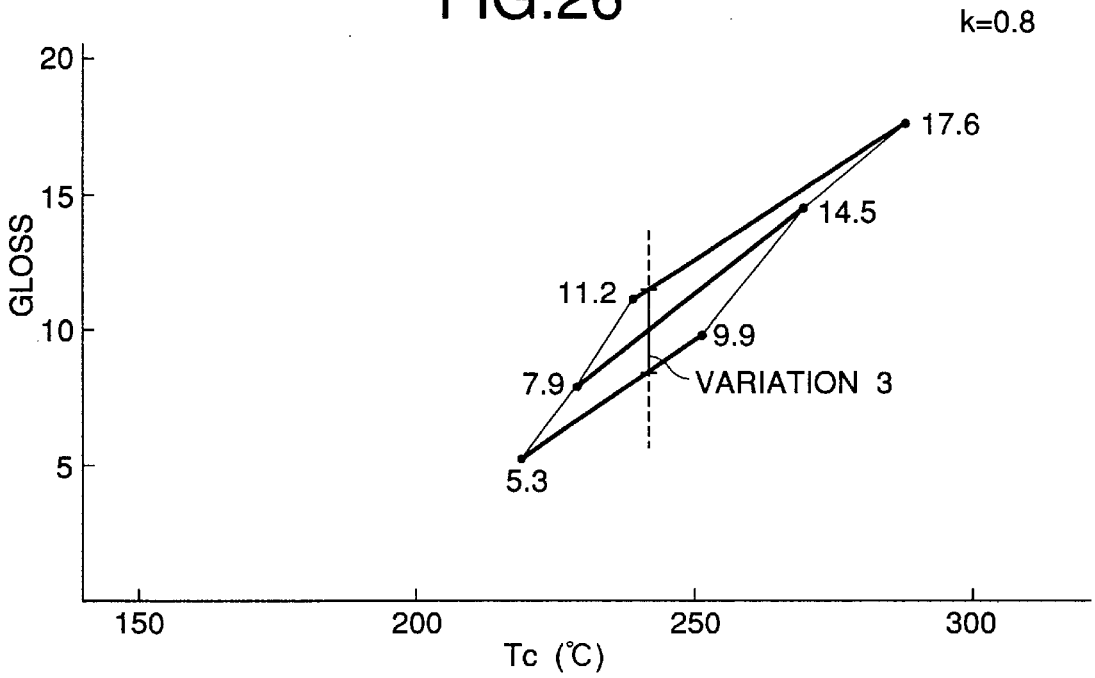
Figure 27:
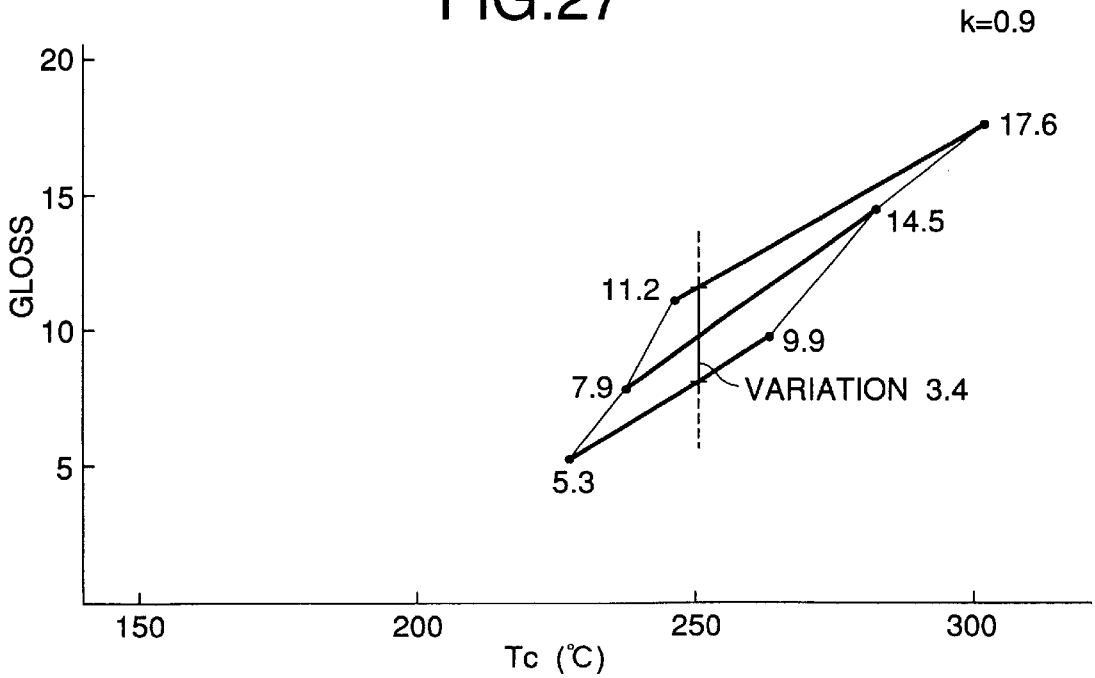

FIG. 4 is a flowchart illustrating the operation of the fixing unit according to the first embodiment.

FIG. 5 illustrates experimental values of gloss for different surface temperatures Th of the heat roller 49 and different surface temperatures Tp of the pressure roller 50 when a magenta toner image is fixed.

FIG. 6 illustrates fixing efficiencies for different surface temperatures Th of the heat roller 49 and different surface temperatures Tp of the pressure roller 50 when the magenta toner image is fixed.

Region AR1 enclosed by thick solid lines indicates a region where the gloss is substantially constant and less than 10 while region AR2 enclosed by thick solid lines represents a region where the gloss is substantially uniform and higher than a predetermined value.

From FIG. 5, it is to be noted that substantially the same gloss can be obtained from particular combinations of surface temperatures Th and Tp. In other words, a constant gloss can be obtained by a constant value of Tc given by Equation (1)

$$Tc=Th+0.5Tp \quad (1)$$

where k is a predetermined experimental coefficient, and is selected to be 0.5 in the embodiment.

In order to keep gloss less than 10 while still maintaining the fixing efficiency less than 10, it only needs to maintain the surface temperatures Th and Tp within Region AR1 or Region AR2. For the next higher value of gloss, Tc should be controlled to, for example, 215° C.

FIGS. 7–17 are tables that list values of Tc for different combinations of Th and Tp for k=0 to k=10 in increments of 0.1. FIGS. 18–28 plot values of Tc shown in FIGS. 7–17 as the abscissa and the values of gloss shown in FIG. 5 as the ordinate. FIGS. 18–28 show graphs for Th=155° C., Th=165° C., and Th=175° C. It is to be noted that lines are drawn to connect the maximum values of the graphs and additional lines are drawn to connect the minimum values of the graphs. The graphs are connected in this manner so as to conveniently determine a value of Tc such that maximum and minimum values of gloss for a given temperature Tc differ from a gloss of 10 by the same amount. It can be said that values of gloss for values of Tc lie in the area bounded by the graphs for Th=175° C. and Th=155° C., the lines connecting the maximum values, and the lines connecting the minimum values. The area is the smallest when k=0.4 and therefore the variation of gloss is the smallest. Drawing lines connecting the maximum and minimum values, respectively, is particularly useful when determining the maximum and minimum vales for k=0–0.3 where the maximum and minimum values cannot be easily determined since the slopes of the graphs are too large.

Referring to FIG. 5, for example, when Th=175° C. and Tp=80° C., the gloss is 11.2. If k=1.0 is selected, Tc is 255° C. from FIG. 17. Therefore, a gloss of 11.2 is plotted on the graph for Th=175° C. in FIG. 28.

Likewise, from FIG. 5, when Th=165° C. and Tp=130° C., the gloss is 14.5. If k=1.0 is selected, Tc is 295° C. from FIG. 17. Therefore, a gloss of 14.5 is plotted on the graph for Th=165° C. in FIG. 28.

Figure 28:
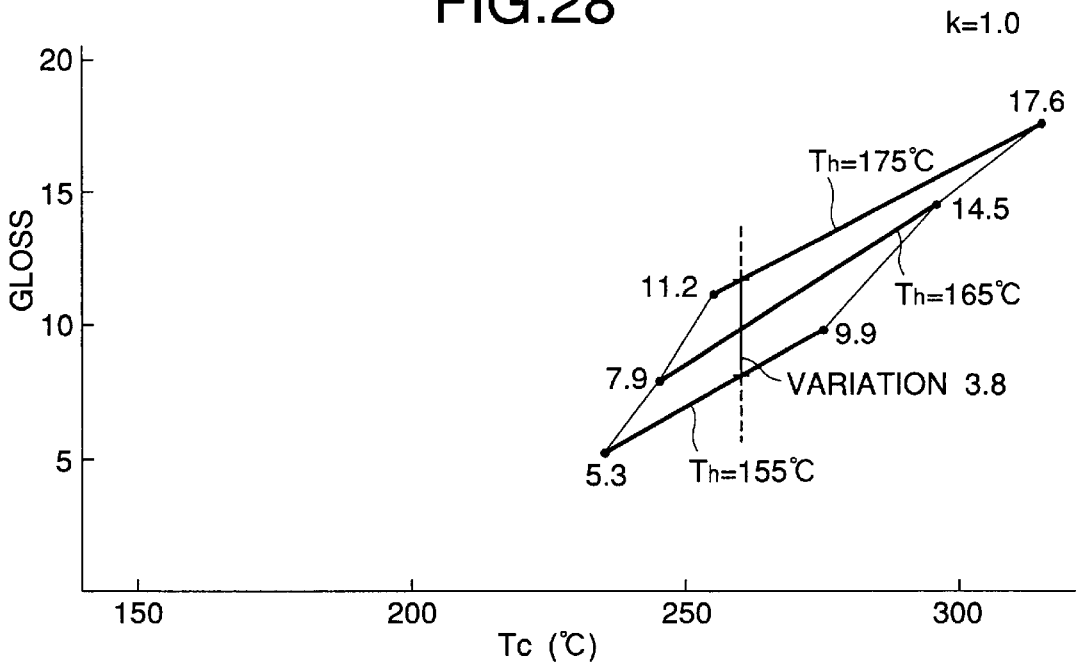

Then, using FIG. 28, a value of Tc is determined such that values of gloss lying on the graphs for Th=175° C. and Th=155° C. deviate from a gloss of 10 by the same amount. Then, the values of gloss are 11.8 on the graph for Th=175° C. and 8.0 on the graph for Th=155° C., respectively at Tc=260° C. Thus, it can be said that the gloss varies from 11.8 to 8.1 in the temperature range from Th=175° C. to Th=155° C. The variation of gloss is 11.8–8.0=3.8.

Figure 29:
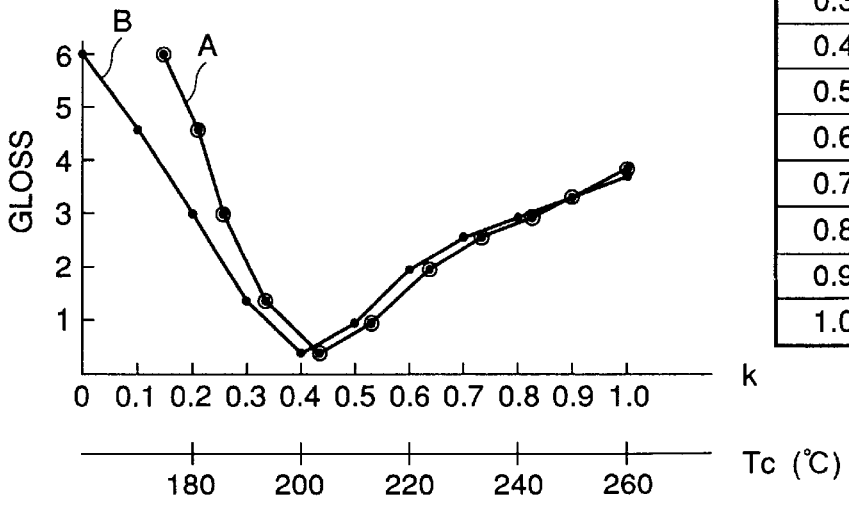
FIG. 29 plots k as the abscissa and gloss as the ordinate.

Curve A and Curve B in FIG. 29 show the variations of gloss determined in the aforementioned manner.

For Curve A, FIG. 29 plots k as the abscissa and gloss as the ordinate. The variation is minimum when k is 0.4. For Curve B, FIG. 29 plots Tc as the abscissa and gloss as the ordinate. Also the variation is minimum when Tc is 210° C. Generally speaking, printed images having a gloss of 3 or less do not give the users any unusual feeling. Thus, k is preferably in the rage of from 0.2 to 0.8. In order to minimize the variations of gloss with temperature Tc, k=0.5 is preferred.

The operation of the fixing unit 48 of the aforementioned construction will now be described.

When the printing operation is activated after reception of the color image signal, the thermistor 102 detects the surface temperature Th and the thermistor 103 detects the surface temperature Tp. Then, the control circuit 51 computes a value of Tc as follows:

$$Tc=Th+0.5Tp$$

A preferred value of Tc is previously determined by experiment for different conditions such as printing speed and the thickness of print medium.

For example, when a print medium 21 of 75 g/m$^2$ travels at a speed of 8 ppm (Page Per Minute), Tc=210° C. provides a good fixing result with a gloss less than 10 while maintaining the same fixing efficiency.

Thus, the heater 101 is energized if Tc<210° C., and the heater 101 is deenergized if Tc≧210° C.

For example, if the surface temperature Tp=90° C., $$Th=Tc-0.5Tp$$
$$=210-45$$
$$=165^\circ \text{ C.}$$

Then, the surface temperature Th is controlled to 165° C. If the surface temperature Tp=80° C., $$Th=Tc-0.5Tp$$
$$=210-40$$
$$=170^\circ \text{ C.}$$

Then, the surface temperature Th is controlled to 170° C.

Finally, a check is made to determine whether the printing has been completed. If the printing has been completed, then the fixing control is terminated.

The aforementioned operation will be described with reference to the flowchart shown in FIG. 4.

Step 1: The surface temperature Th of the heat roller 49 is detected.

Step 2: The surface temperature Tp of the pressure roller 50 is detected.

Step 3: A value of Tc is calculated on the basis of Th and Tp.

Step 4: A check is made to determine whether Tc is equal to or higher than 210° C. If the answer is YES, the program proceeds to step S5, if NO, the program proceeds to step S6.

Step 5: The heater 101 is deenergized.

Step 6: The heater is energized.

Step 7: A check is made to determine whether the printing has completed. If YES, the operation of the fixing unit is ended. If NO, the program returns to step S1.

The changes in surface temperatures Th and Tp during the fixing operation will be described.

Figure 30:
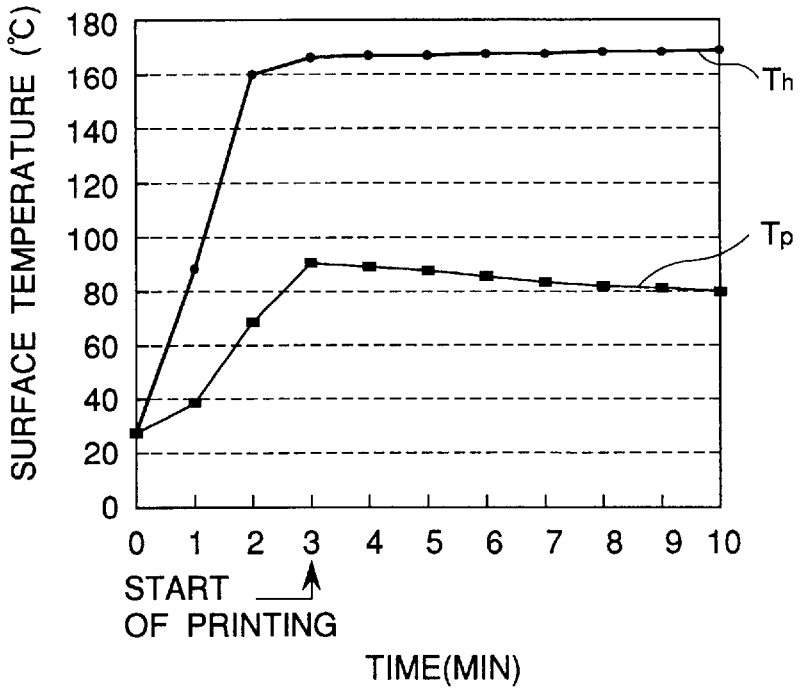
FIG. 30 illustrates changes in the surface temperatures of the heat roller and pressure roller when a continuous printing is performed using the fixing unit of the first embodiment.

FIG. 30 illustrates changes in the surface temperatures of the heat roller 49 and pressure roller 50 when a continuous printing is performed using the fixing unit 48 of the first embodiment. FIG. 30 plots time as the abscissa and surface temperatures as the ordinate.

As shown in FIG. 30, if a printing is performed continuously on a plurality of pages of print medium after the fixing unit 48 has become ready for a fixing operation, the surface temperature Tp of the pressure roller 50 gradually decreases with time while the surface temperature Th of the heat roller 49 is gradually increased.

Figure 31:
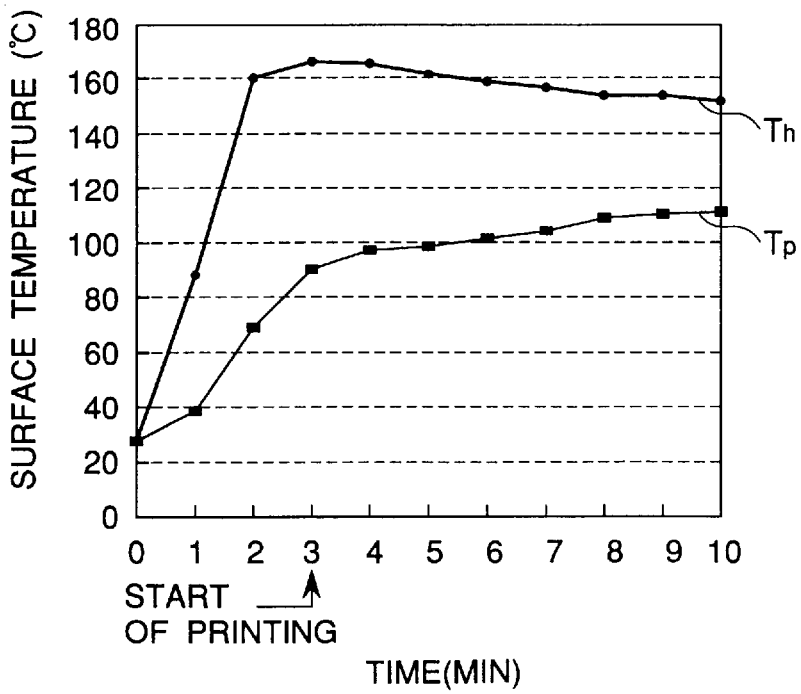
FIG. 31 illustrates changes in the surface temperatures of the heat roller and pressure roller when a printing is performed intermittently using the fixing unit of the first embodiment.

FIG. 31 illustrates changes in the surface temperatures of the heat roller 49 and pressure roller 50 when a printing is performed intermittently using the fixing unit of the first embodiment. FIG. 31 plots time as the abscissa and surface temperatures as the ordinate.

As shown in FIG. 31, if a printing is performed intermittently by stopping the operation of the fixing unit 48 every time a page of print medium 21 is printed, the surface temperature Tp of the pressure roller 50 gradually increases with time while the surface temperature Th of the heat roller 49 is gradually is decreased. If the a relatively long time is allowed between pages, the surface temperature Tp gradually increases with time while the surface temperature Th is gradually decreased accordingly.

As described above, even though the surface temperature Tp varies, a good fixing operation can be effected with a constant gloss of less than 10 while still maintaining a fixing efficiency greater than a certain value, thereby improving the quality of printed images as well as preventing the offset phenomenon.

The pressure roller 50 does not need a built-in heater, thereby requiring no extra electric power as well as preventing increases in manufacturing cost. A gradual increase in the surface temperature Tp allows a gradual decrease in the target surface temperature of the heat roller once the surface temperature Th has reached an initial target value. This implies that the fixing unit 48 can be warmed up to a predetermined surface temperature in a shorter time after printing each page in the intermittent printing operation.

Second Embodiment

In the first embodiment, if the thermistor 103 is disposed in a longitudinal direction at substantially a center of the pressure roller 50, the toner, paper particles or the like will be accumulated on the surface of the thermistor 103 after a long time use, so that the surface of the pressure roller 50 is eventually worn out and lines of contaminants appear on the surface of the print medium after fixing. Therefore, the thermistor 103 is usually disposed at one longitudinal end of the pressure roller 50.

Figure 32:
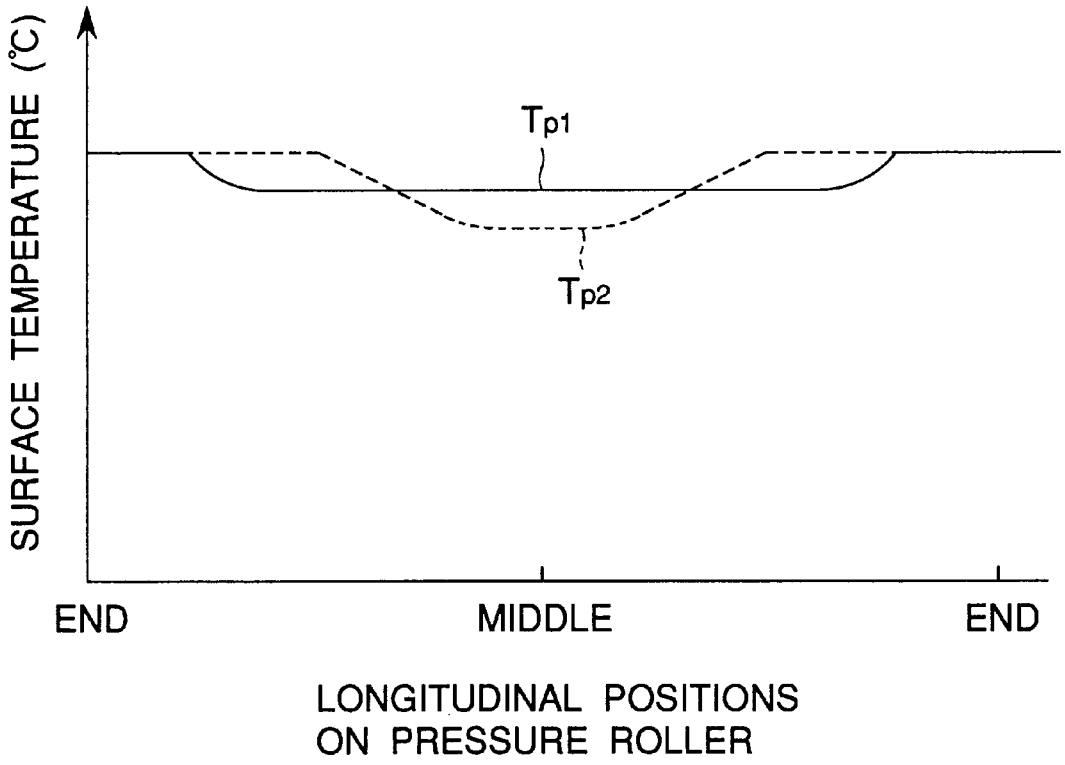
FIG. 32 illustrates the profile of the surface temperature Tp of the pressure roller of the first embodiment.

Amounts of heat lost to the print medium along the length of the pressure roller 50 are different depending on the widths of the print medium. Therefore, the temperature profiles differ depending on the widths of the print medium. When the print medium has a narrow width, the temperatures at longitudinal ends of the pressure roller is different from that longitudinally in the middle. FIG. 32 illustrates the profile of the surface temperature Tp of the pressure roller 50. FIG. 32 plots points on the pressure roller 50 as the abscissa and surface temperatures Tp as the ordinate.

Referring to FIG. 32, Tp1 shows the surface temperature of the pressure roller 50 when a fixing is performed on a wide-width print medium such as A4 size paper while Tp2 shows the surface temperature of the pressure roller 50 when a fixing is performed on a narrow-width print medium such as A5 size paper. As is clear from FIG. 32, a print medium having a narrow width causes a larger difference in surface temperature between the middle portion and longitudinal ends of the pressure roller 50 than a print medium having a wide width.

When a continuous printing is performed, the surface temperature of the pressure roller 50 on which the print medium 21 passes gradually decreases, causing even larger differences in temperature between the middle of the pressure roller and the longitudinal ends. This implies that if the temperature control of the fixing unit 48 is performed by detecting the surface temperature of the longitudinal end of the pressure roller 50 using the thermistor 103 just as in the first embodiment, the gloss of color image printed on a narrow print medium 21 in a continuous printing mode will be different from page to page, impairing the quality of printed images as well as causing the offset phenomenon.

Figure 33:
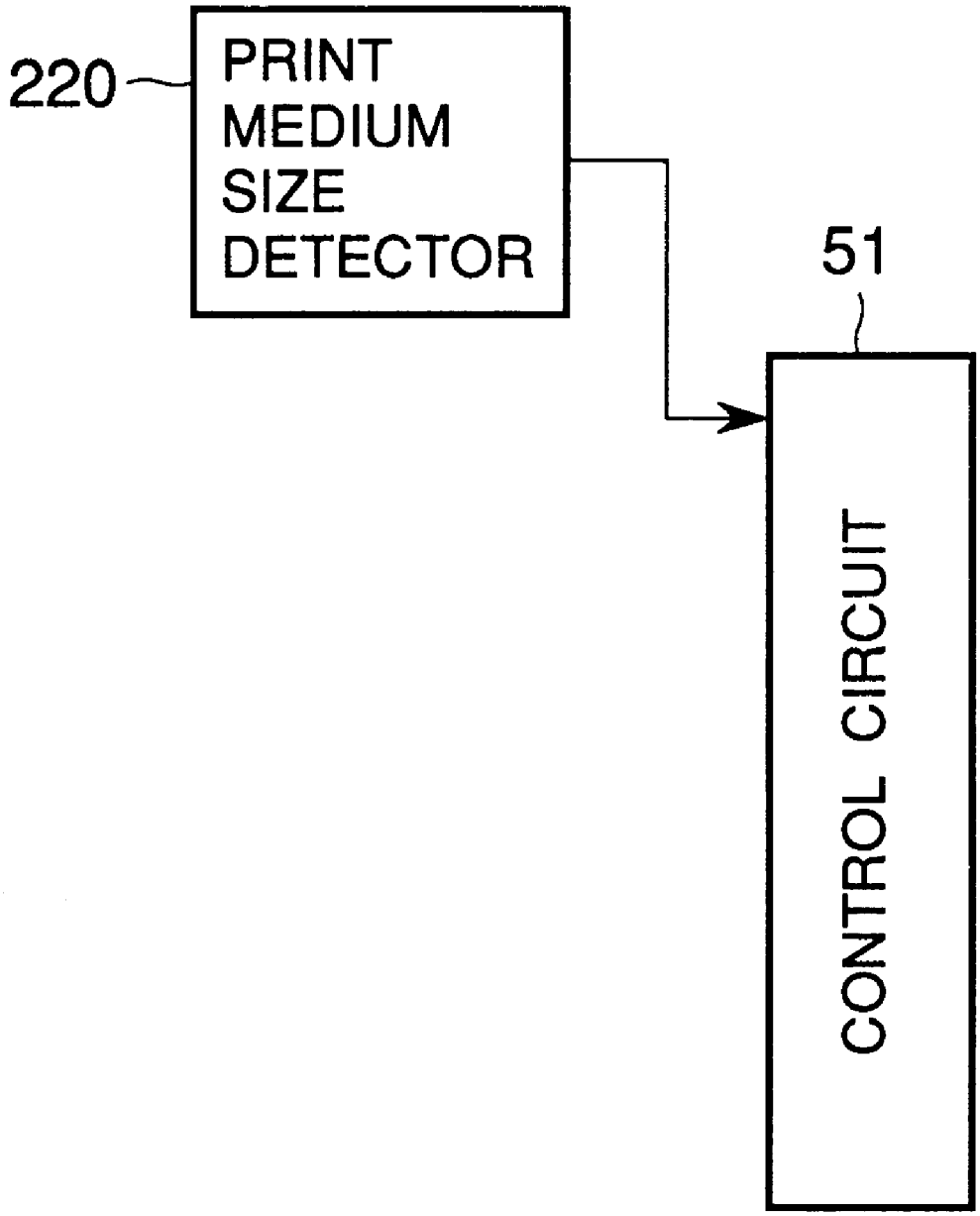
FIG. 33 illustrates a control circuit and a print medium size detector of a color image recording apparatus according to a second embodiment.

This problem is solved by a second embodiment. The second embodiment differs from that shown in FIG. 3 in that a print medium size detector 220 is added as shown in FIG. 33.

Figure 34:
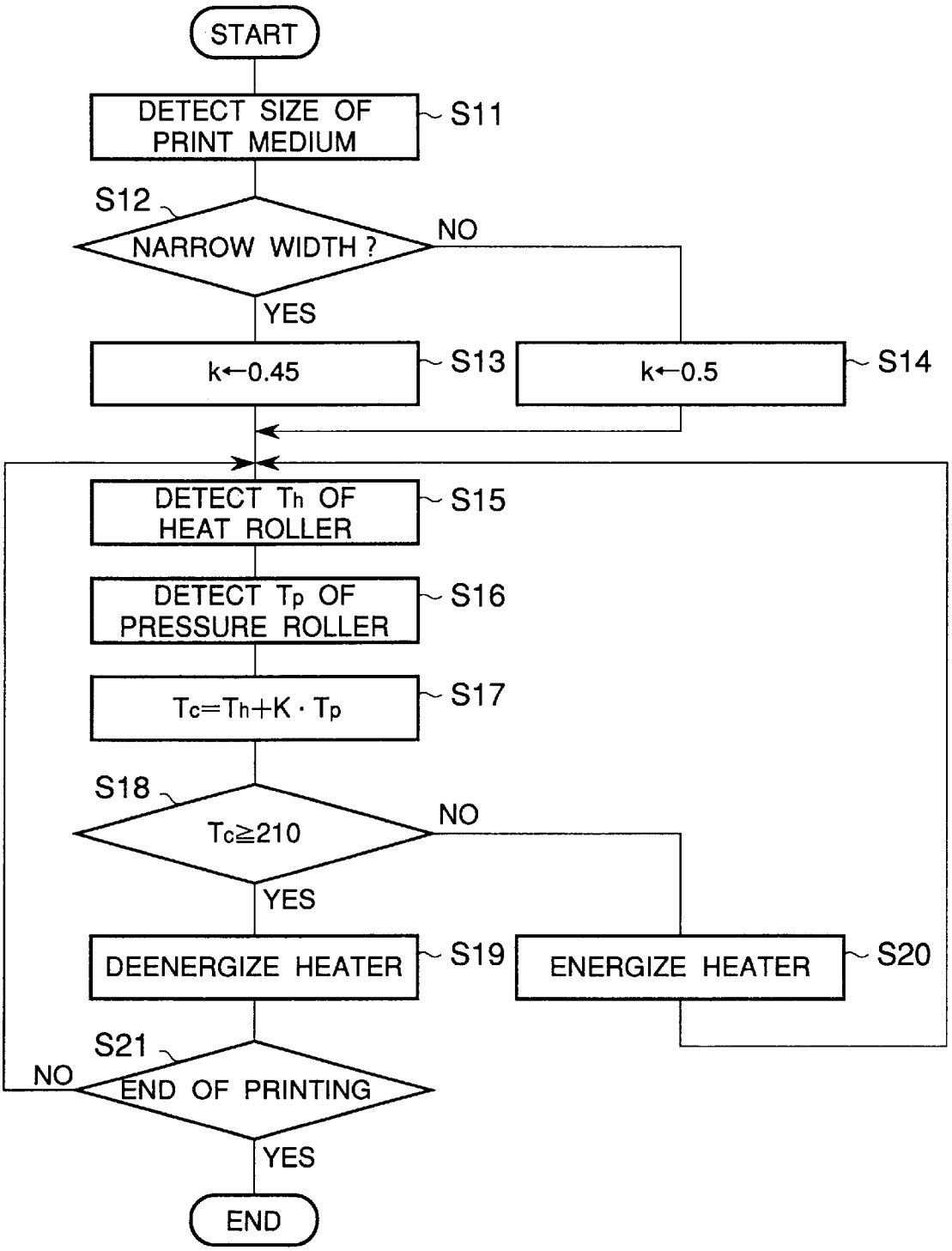
FIG. 34 is a flowchart illustrating the operation of a fixing unit according to the second embodiment.

FIG. 34 is a flowchart illustrating the operation of a fixing unit according to the second embodiment. Elements similar to those of the first embodiment have been given the same reference numerals and the description thereof are omitted.

In the second embodiment, the control circuit 51 is connected to a medium size detecting circuit 220 which detects the size of the print medium 21 (FIG. 2).

When the printing operation is activated after reception of the color image signal, the medium size detecting circuit 220 detects the size of the print medium and the control circuit 51 checks the output of the medium size detecting circuit 220 to determine whether the width of the print medium 21 is wide. In the second embodiment, it is assumed that an A5 size medium is a narrow print medium and A4 size medium is a wide print medium.

The thermistor 102 as the first temperature detecting means detects the surface temperature Th of the heat roller 49 (FIG. 1) as a first roller. The thermistor 103 as the second temperature detecting means detects the surface temperature Tp of the pressure roller 50 (FIG. 1) as a second roller. Then, the control circuit 51 calculates the value of Tc as follows:

$$Tc=Th+k\cdot Tp$$

where k has the range $0<k<1$ and k is 0.45 for a narrow print medium and 0.5 for a wide print medium. The value of k is determined by experiment.

For a narrow print medium 21, if the surface temperature Tp is 90° C., then $$Th=Tc-0.45Tp$$
$$=210-40.5$$
$$=169.5^\circ\ \text{C.}$$

if the surface temperature Tp is 90° C., then $$Th=Tc-0.45Tp$$
$$=210-40.5$$
$$=169.5^\circ\ \text{C.}$$

Thus, the surface temperature Th is controlled to about 170° C.

If the surface temperature Tp is 80° C., then $$Th=Tc-0.45Tp$$
$$=210-36$$
$$=174^\circ\ \text{C.}$$

Thus, the surface temperature Th is controlled to about 174° C.

For a wide print medium, if the surface temperature Tp is 90° C., then $$Th=Tc-0.5Tp$$

$$=210-45$$

$$=165^\circ \text{ C.}$$

Thus, the surface temperature Th is controlled to about 165° C.

If the surface temperature Tp is 80° C., then $$Th=Tc-0.5Tp$$

$$=210-40$$

$$=170^\circ \text{ C.}$$

Thus, the surface temperature Th is controlled to about 170° C.

As mentioned above, the surface temperature Tp at the middle of the pressure roller 50 is the same for a narrow print medium 21 and a wide print medium 21, while the surface temperature Th is higher for the narrow print medium 21 than for the wide print medium 21. Thus, when a continuous printing is performed on narrow print media, the gloss of printed color images are not deteriorated or subjected to the offset phenomenon.

While the second embodiment has been described with respect to two kinds of print medium, i.e., A4 size and A5 size, more number of sizes can of course be assumed.

The flowchart shown in FIG. 34 will be described.

Step 11: The size of the print medium 21 is detected.

Step 12: A check is made to determine whether the print medium 21 has a narrow width. If narrow, then the program proceeds to step S13, and if not narrow, then the program proceeds to step S14.

Step 13: The coefficient k is set to 0.45.

Step 14: The coefficient k is set to 0.5.

Step 15: The surface temperature Th of the heat roller 49 is detected.

Step 16: The surface temperature Tp of the pressure roller 50 is detected.

Step 17: The value of Tc is calculated on the basis of the surface temperatures Th and Tp.

Step 18: A check is made to determine whether the value of Tc is equal to or higher than 210° C. If YES, the program proceeds to step S19, and if NO, then the program proceeds to step S20.

Step 19: The heater 101 is deenergized.

Step 20: The heater 101 is energized and then the program loops back to step S15.

Step 21: A check is made to determined whether the printing should be terminated. If YES, then the program ends, and if NO, then the program loops back to step S15.

Third Embodiment

The control circuit 51 monitors the temperature of the heat roller 49 and pressure roller 50 by means of the temperature detectors 102 and 103, respectively. The control circuit 51 also monitors the interior temperature and humidity by means of an interior temperature detector 75*a* and an interior humidity detector 70*b*, respectively. The control circuit determines and controls the target temperatures of the heat roller 49 and pressure roller 50 for the temperatures in accordance with the kinds of print medium and the environment.

Figure 35:
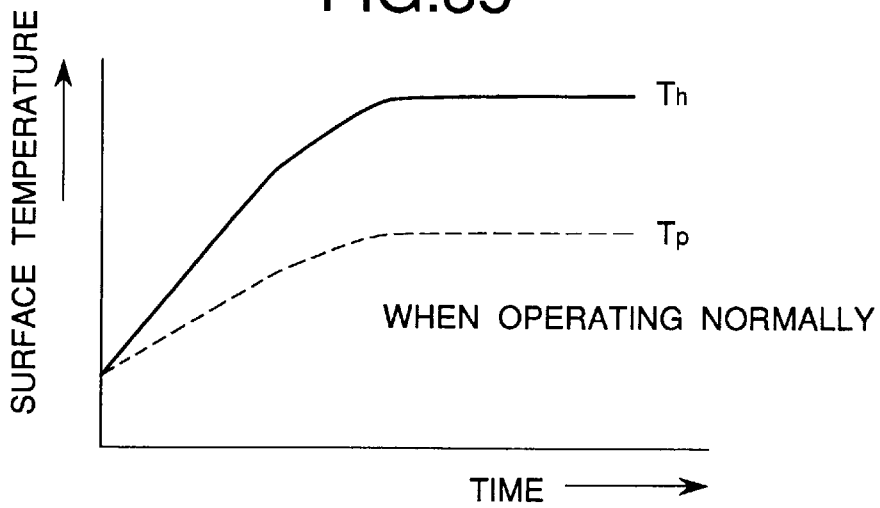
FIG. 35 shows the surface temperatures Th and Tp when the fixing unit is normally operating.

The heat roller 49 includes the heater 101 therein while the pressure roller 50 does not include a heating element. The pressure roller 50 is in pressure contact with the heat roller 49 and receives heat from the heat roller 49 so that the surface temperature of the pressure roller 50 increases. Thus, as shown in FIG. 35, the surface temperature Tp of the pressure roller 50 increases as the temperature of the heat roller 49 increases with a certain temperature difference between the heat roller 49 and the pressure roller 50.

Figure 36:
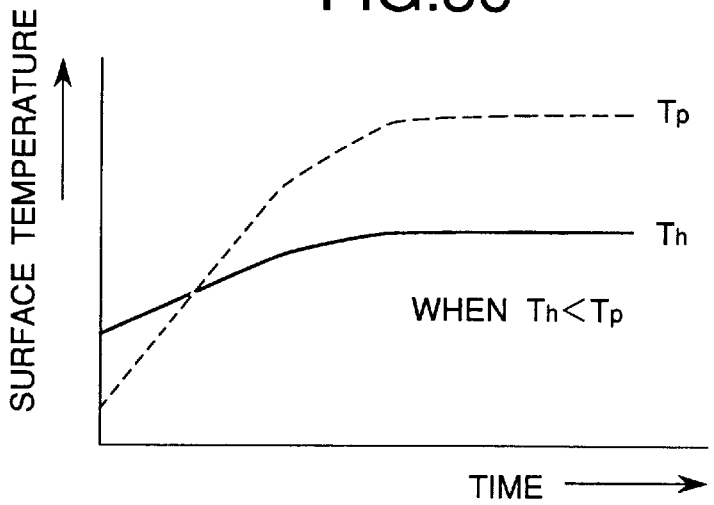
FIG. 36 shows the surface temperatures Th and Tp when Th is lower than Tp.
Figure 37:
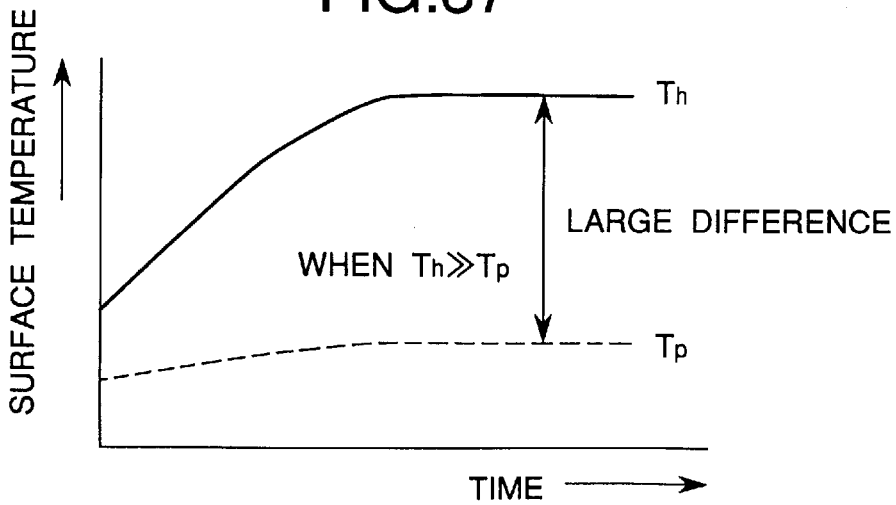
FIG. 37 shows the surface temperatures Th and Tp when Th is much higher than Tp.

As shown in FIG. 36, if the surface temperature Th of the heat roller 49 detected by the thermistor 102 is lower than that of the pressure roller 50 detected by the thermistor 103, the temperatures may not have been detected correctly for some reason. For example, If the thermistor 102 is not in sufficient pressure contact with the heat roller 49, then the output of the thermistor 102 may be lower than that of the thermistor 103 in pressure contact with the pressure roller 50.

If the printer is left turned off for a long period of time, the temperatures of the heat roller 49 and the pressure roller 50 decreas to ambient temperature, so that the heat roller 49 and the pressure roller 50 will reach the same temperature. Temperatures detected by the thermistors 102 and 103 usually are within a certain error margin. When the outputs of the thermistors 102 and 103 are within that error margin to each other, it is difficult to accurately determine which one of the temperatures Th and Tp is actually higher than the other. If the printer is to be turned off just because the output of the thermistor 102 is slightly smaller than the that of the thermistor 103 and a "occurrence of trouble" is indicated to the user, then there will be frequent false indication of trouble.

Thus, if the temperature Th of the heat roller detected by the thermistor 102 is higher than that Tp of the pressure roller 50 detected by the thermistor 103 and the difference between the temperatures Tp and Th is larger than the error margin of the thermistor outputs, the control circuit 51 determines that the temperatures Tp and Th of the heat roller 49 and pressure roller 50 have not been detected correctly, and stops the operation of the printer. Then, the control circuit 51 informs the host apparatus such as a host computer on the occurrence of trouble.

Figure 38:
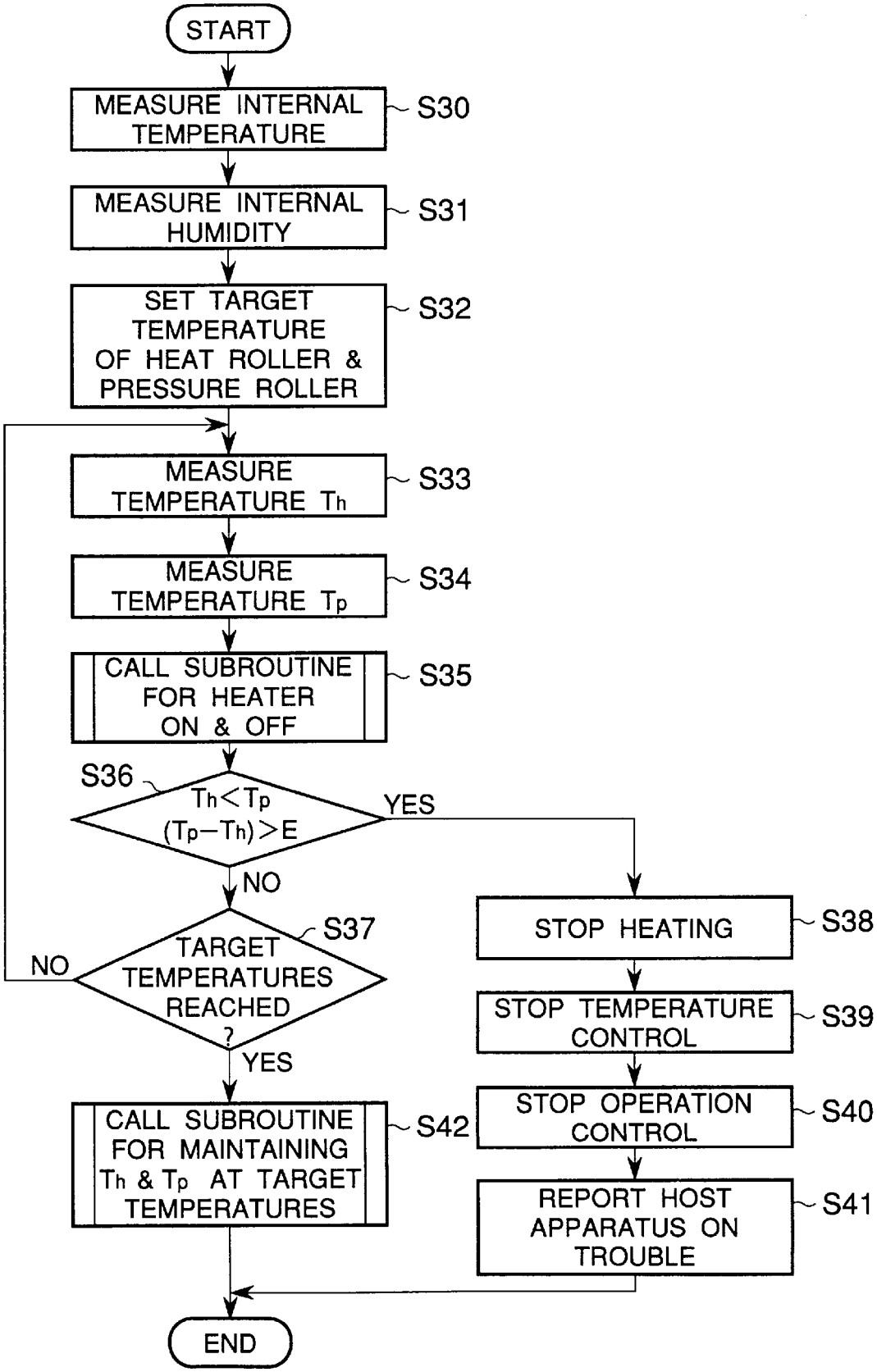
FIG. 38 is a flowchart which illustrates the temperature control of the fixing unit according to a third embodiment.

FIG. 38 is a flowchart which illustrates the temperature control of the fixing unit 48.

Step 30: The interior temperature of the printer is detected using the interior temperature detector 75*a*.

Step 31: The interior humidity of the printer is detected using the interior humidity detector 75*b*.

Step 32: The target temperatures of the heat roller 49 and pressure roller 50 are set on the basis of the interior temperature and interior humidity detected at steps 1 and 2.

Step 33: The temperature Th of the heat roller 49 is detected using the thermistor 102.

Step 34: The temperature Tp of the pressure roller 50 is detected using the thermistor 103.

Step 35: A subroutine is called which controllably energizes the heater 101 to heat the heat roller 49.

Step 36: A check is made to determine whether Th>Tp and (Tp−Th)>E, E being a predetermined value.

Step 37: If the answer is YES at step 36, then the program proceeds to step 38. If NO, then the program proceeds to step 42.

Step 38: The heater 101 is deenergized.

Step 39: The temperature control is stopped.

Step 40: The operation of the printer is stopped.

Step 41: The control circuit 51 informs the host apparatus on the trouble.

Step 42: A subroutine program is called which maintains the temperatures of the heat roller 49 and pressure roller 50 at the target temperatures.

The fixing unit 48 is operated under the aforementioned program, thereby enabling detection of abnormal temperatures of the heat roller 49 and pressure roller 50 as well as preventing excess increases in the temperature of the fixing unit and poor fixing results.

<Modification of Third embodiment>

Figure 39:
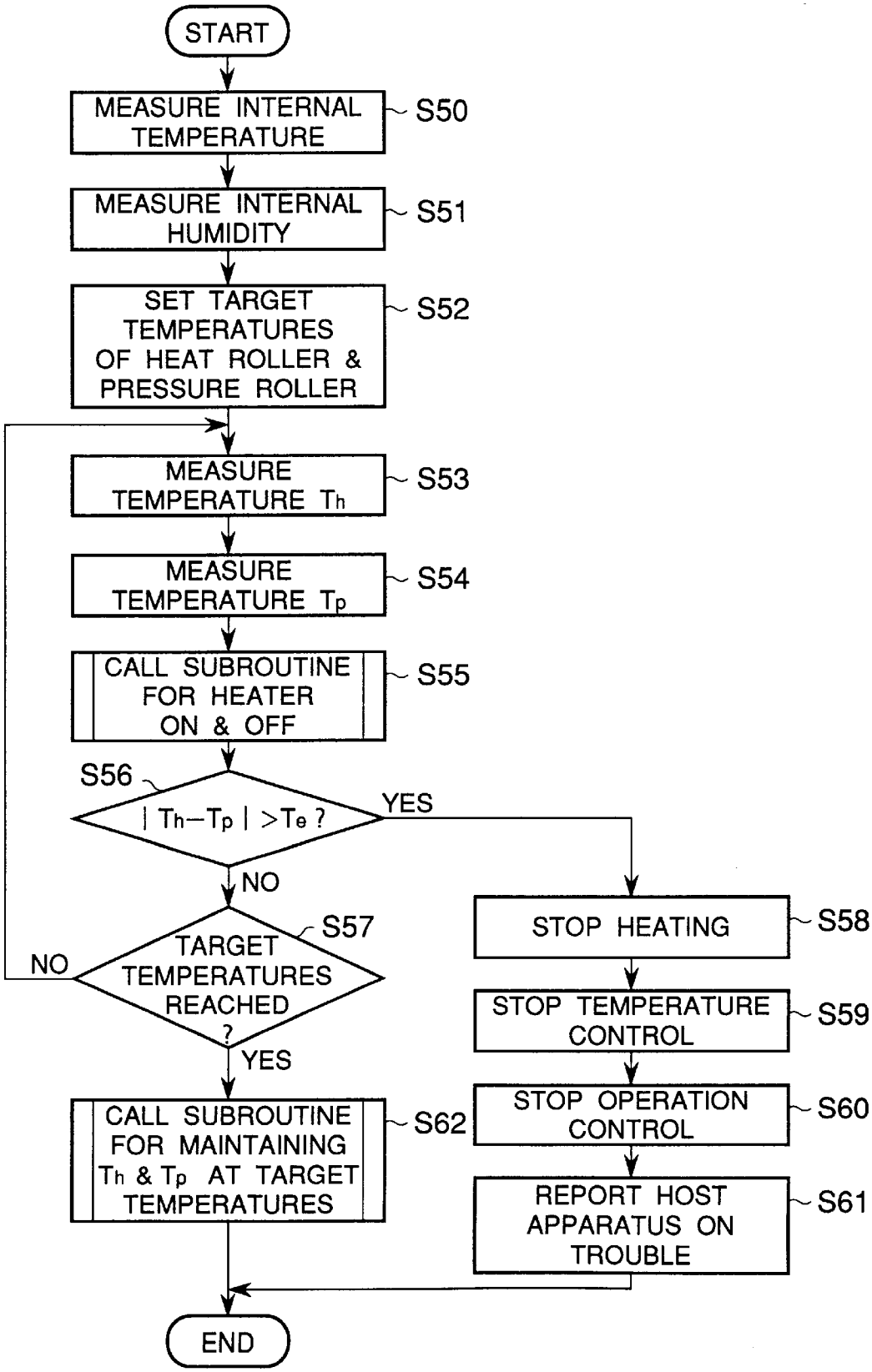
FIG. 39 illustrates a modification of the temperature controlling operation of the third embodiment.
Figure 40:
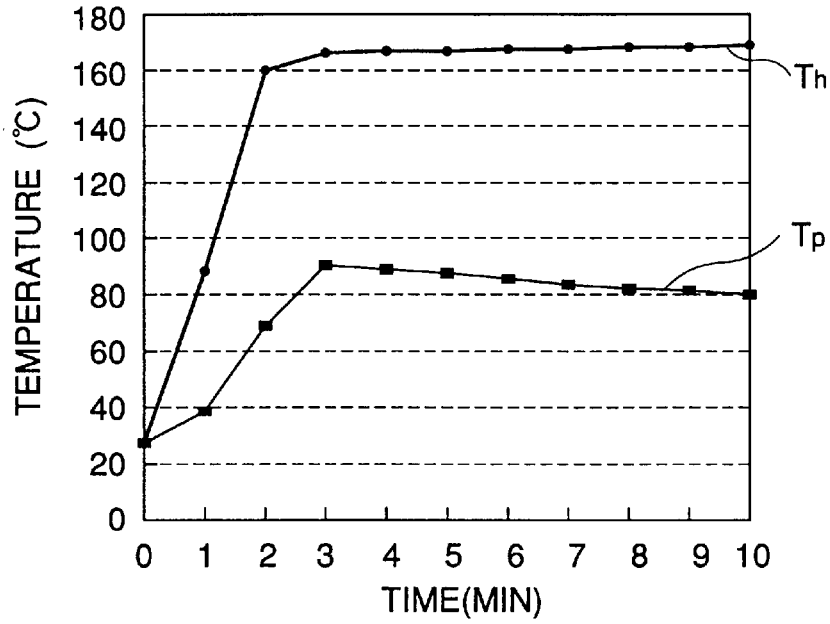
FIG.40 CONVENTIONAL ART
FIG. 40 illustrates changes in the surface temperatures of the heat roller and pressure roller of a conventional fixing unit when a continuous printing is performed.
Figure 41:
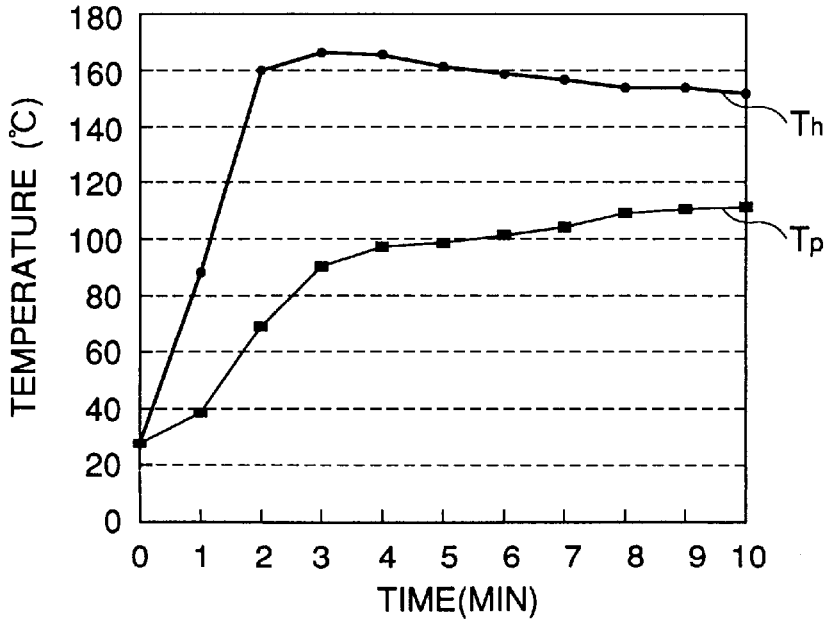
FIG.41 CONVENTIONAL ART
FIG. 41 illustrates changes in the surface temperatures of the heat roller and pressure roller of the conventional when a plurality of pages are printed intermittently with long intervals between pages.

FIG. 39 illustrates a modification of the temperature controlling operation. Steps 50–55 and steps 58–62 shown in FIG. 39 are identical to steps 30–35 and steps 38–42 shown in FIG. 38, respectively. Step 56 of FIG. 39 is different from step 36 of FIG. 38.

If the absolute value |Th−Tp| of a difference between the heat roller and pressure roller is larger than a temperature value Te when the fixing unit is normally operating, then the temperatures may not have been detected correctly for some reason. In such a case, the control circuit 51 determines that the temperatures are not detected normally, and stops the operation of the printer.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fixing unit comprising:

a first fixing member having a heater and a heaterless second fixing member disposed to oppose said first fixing member to hold and advance a print medium therebetween in sandwiched relation;

a first temperature detector which detects a surface temperature of said first fixing member and outputs a first signal indicative of the surface temperature of said first fixing member;

a second temperature detector which detects a surface temperature of said second fixing member and outputs a second signal indicative of the surface temperature of said second fixing member, said second signal being attenuated by a selected attenuation coefficient to provide an attenuated signal;

a controller combining the first signal with said attenuated signal to produce a third signal, the controller controlling energization of the heater in accordance with the third signal so as to maintain the temperature of said first fixing member to a target temperature.

2. The fixing unit according to claim 1, wherein the heater element is energized to maintain a constant value of Tc given by an equation:

$$Tc=Th+k\cdot Tp$$

where Th is a surface temperature of said first fixing member, Tp is a surface temperature of said second fixing member, and k is a coefficient having the range of $0<k<1$.

3. The fixing unit according to claim 2, wherein the value of k is 0.5.

4. A fixing unit comprising:

a first fixing member having a heater element;

a second fixing member disposed to oppose said first fixing member to hold and advance a print medium therebetween in sandwiched relation;

a first temperature detector which detects a temperature of said first fixing member and outputs a first signal indicative of the temperature of said first fixing member;

a second temperature detector which detects a temperature of said second fixing member and outputs a second signal indicative of the temperature of said second fixing member;

a controller which controls the heater element in accordance with the first signal and second signal so as to maintain the temperature of said first fixing member to a target temperature, wherein the heater element is energized to maintain a constant value of Tc given by the equation:

$$Tc=Th+k\cdot Tp$$

where Th is a surface temperature of said first fixing member, Tp is a surface temperature of said second fixing member, and k is a coefficient having a range of $0<k<1$; and a medium size detector which detects a width of the print medium, the controller selectively sets a value of the coefficient in accordance with the width of the print medium.

5. The fixing unit according claim 4, wherein the value of the coefficient k is smaller for a print medium having a narrow width than for a print medium having a wide width.

6. The fixing unit according to claim 4, wherein said first fixing member is a heat roller and said second fixing member is a pressure roller in pressure contact with said heat roller.

7. A fixing unit comprising:

a first fixing member having a heater element;

a second fixing member disposed to oppose said first fixing member to hold and advance a print medium therebetween in sandwiched relation;

a first temperature detector which detects a temperature of said first fixing member and outputs a first signal indicative of the temperature of said first fixing member;

a second temperature detector which detects a temperature of said second fixing member and outputs a second signal indicative of the temperature of said second fixing member;

a controller which controls the heater element in accordance with the first signal and second signal so as to maintain the temperature of said first fixing member to a target temperature, wherein the heater element is energized to maintain a constant value of Tc given by the equation:

$$Tc=Th+k\cdot Tp$$

where Th is a surface temperature of said first fixing member, Tp is a surface temperature of said second fixing member, and k is a coefficient having a range of $0<k<1$, wherein if Th<Tp, then the controller stops an operation of the fixing unit.

8. The fixing unit according to claim 7, wherein if a difference between the surface temperature of said first fixing member and the surface temperature of said second fixing member is greater than a predetermined value, then the controller stops an operation of the fixing unit.

9. A fixing unit comprising:

a first fixing member having a heater element;

a second fixing member disposed to oppose said first fixing member to hold and advance a print medium therebetween in sandwiched relation;

a first temperature detector which detects a temperature of said first fixing member and outputs a first signal indicative of the temperature of said first fixing member;

a second temperature detector which detects a temperature of said second fixing member and outputs a second signal indicative of the temperature of said second fixing member;

a controller which controls the heater element in accordance with the first signal and second signal so as to maintain the temperature of said first fixing member to a target temperature, wherein the heater element is energized to maintain a constant value of Tc given by the equation:

$$Tc=Th+k\cdot Tp$$

where Th is a surface temperature of said first fixing member, Tp is a surface temperature of said second fixing member, and k is a coefficient having a range of 0<k<1, wherein if a difference between the surface temperature of said first fixing member and the surface temperature of said second fixing member is greater than a predetermined value, the controller stops an operation of the fixing unit.

* * * * *